US011859342B2

(12) United States Patent
Choe et al.

(10) Patent No.: US 11,859,342 B2
(45) Date of Patent: Jan. 2, 2024

(54) LAUNDRY DRYING MACHINE AND CONTROLLING METHOD OF LAUNDRY DRYING MACHINE

(71) Applicant: LG Electronics Inc., Seoul (KR)

(72) Inventors: Woonje Choe, Seoul (KR); Myunghun Im, Seoul (KR); Seungwoo Han, Seoul (KR); Nagyoung Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 90 days.

(21) Appl. No.: 17/191,108

(22) Filed: Mar. 3, 2021

(65) Prior Publication Data

US 2021/0277586 A1 Sep. 9, 2021

(30) Foreign Application Priority Data

Mar. 3, 2020 (KR) ..... 10-2020-0026722
Mar. 3, 2020 (KR) ..... 10-2020-0026723

(51) Int. Cl.
*D06F 58/44* (2020.01)
*D06F 58/40* (2020.01)
(Continued)

(52) U.S. Cl.
CPC ..... *D06F 58/44* (2020.02); *D06F 58/203* (2013.01); *D06F 58/24* (2013.01); *D06F 58/263* (2013.01);
(Continued)

(58) Field of Classification Search
CPC ..... D06F 58/44; D06F 58/203; D06F 58/24; D06F 58/263; D06F 58/40;
(Continued)

(56) References Cited

U.S. PATENT DOCUMENTS 9,267,229 B2 * 2/2016 Oh ..... D06F 58/203
2009/0320322 A1 * 12/2009 Kim ..... D06F 58/203 700/275
2016/0215438 A1 * 7/2016 Chernetski ..... D06F 58/203

FOREIGN PATENT DOCUMENTS

EP 2434047 A2 * 3/2012 ..... D06F 58/22
EP 2390404 7/2016
(Continued)

OTHER PUBLICATIONS

English translation KR-20090083325-A Aug. 2009 (Year: 2009).*
(Continued)

*Primary Examiner* — Jessica Yuen
(74) *Attorney, Agent, or Firm* — Fish & Richardson P.C.

(57) ABSTRACT

Disclosed herein is a method of controlling a laundry dryer for generating high-temperature steam through a steam part and controlling each of rotation of a drum and rotation of a circulation fan. The method includes a steam drying procedure drying operation of increasing an internal temperature of the drum to dry an object to be dried, a steam drying procedure steam supply operation of supplying steam into the drum after the steam drying procedure drying operation, and a re-drying operation of supplying hot air into the drum after the steam drying procedure steam supply operation. When steam is sprayed from the steam part, the rotation of the drum is maintained, the rotation of the circulation fan is stopped, such that the steam is evenly supplied to the object to be dried, damage to the object is prevented, and sterilization of the object is enhanced.

15 Claims, 19 Drawing Sheets

(51) Int. Cl.

| | |
|---|---|
| ***D06F 58/20*** | (2006.01) |
| ***D06F 58/24*** | (2006.01) |
| ***D06F 58/26*** | (2006.01) |
| ***D06F 103/32*** | (2020.01) |
| ***D06F 105/20*** | (2020.01) |
| ***D06F 105/40*** | (2020.01) |

(52) U.S. Cl.
CPC ..... *D06F 58/40* (2020.02); *D06F 2103/32* (2020.02); *D06F 2105/20* (2020.02); *D06F 2105/40* (2020.02)

(58) Field of Classification Search
CPC ..... D06F 2103/32; D06F 2105/20; D06F 2105/40; D06F 34/26; D06F 58/38; D06F 2103/06; D06F 2103/62; D06F 2105/26; D06F 2105/30; D06F 2105/46; D06F 58/206; D06F 25/00; D06F 39/008
See application file for complete search history.

(56) References Cited

FOREIGN PATENT DOCUMENTS

| | | | | |
|---|---|---|---|---|
| EP | 2765235 B1 | * | 3/2019 | ..... D06F 58/28 |
| EP | 3276071 | | 5/2019 | |
| JP | 2009254615 A | * | 11/2009 | |
| KR | 20090083325 A | * | 8/2009 | |
| KR | 1020090118213 | | 11/2009 | |

OTHER PUBLICATIONS

English translation, EP-2434047-A2, Mar. 2012 (Year: 2012).*
English translatio, JP-2009254615-A,Nov. 2009 (Year: 2009).*
EP Extended European Search Report in European Appln. No. 21159933.7, dated Sep. 7, 2021, 8 pages.

* cited by examiner

| Strain | Staphylococcus aureus | Escherichia coli | Pseudomonas aeruginosa | Klebsiella pneumoniae |
|---|---|---|---|---|
| Sterilization condition | 60°C 30min<br>70°C 10min | 60°C 10min | 55°C 30min | Klebsiella pneumoniae: 50°C 20min |

LAUNDRY DRYING MACHINE AND CONTROLLING METHOD OF LAUNDRY DRYING MACHINE

CROSS-REFERENCE TO RELATED APPLICATIONS

This application claims the benefit of Korean Patent Application Nos. 10-2020-0026722 and 10-2020-0026723, filed on Mar. 3, 2020, respectively, the disclosures of which are hereby incorporated by reference as if fully set forth herein.

TECHNICAL FIELD

The present disclosure relates to a laundry dryer and a control method of the laundry dryer, and more particularly, to a laundry dryer configured to spray high-temperature steam into a drum through a steam part and control rotation of the drum and rotation of a fan, respectively, and a control method of the laundry dryer.

BACKGROUND

In recent years, a clothes treatment apparatus capable of perform a drying process to remove water from clothes. The conventional clothes treatment apparatus may not only greatly shortens the drying time of clothes by drying clothes with hot air supplied to a drum accommodating the clothes, but also sterilize and disinfect the clothes.

Among the conventional clothes treatment apparatuses configured to perform a drying process, there is a conventional clothes treatment apparatus that is configured to supply steam to clothes in order to remove wrinkles from the clothes, improve drying efficiency, or perform sterilization.

Korean Patent No. 10-1319874 discloses a control method of a dryer for drying clothes after supplying steam to clothes.

In the conventional dryer, a drum and a blower unit are coupled to one motor, and thus the drum and the blower unit rotate or stop at the same time according to rotation of the motor.

Accordingly, when steam is sprayed into the drum, rotation of the drum and the blower unit is stopped in order to sufficiently supply the steam to an object to be dried.

However, when steam is sprayed with the drum stopped, steam is supplied only to the upper surface of the object to be dried, and thus there is a limitation in preventing damage to the object and providing a sterilization effect for the object to be dried when steam spray is performed.

SUMMARY

An object of the present disclosure devised to address the above-described issues raised in relation to the conventional laundry dryer and control method of the laundry dryer is to prevent damages to an object to be dried and provide a sterilization effect for the object to be dried by evenly supplying steam to the object to be dried by rotating a drum while spraying steam.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the disclosure, as embodied and broadly described herein, a laundry dryer may include a drum rotatably arranged inside a cabinet to accommodate an object to be dried, the cabinet defining an exterior, a duct part configured to resupply air discharged from the drum to the drum, a circulation fan configured to provide flow force to air moving along the duct part, an evaporator and a condenser arranged on the duct part to perform heat exchange with the air circulating along the duct part, a compressor configured to compress a refrigerant performing heat exchange with the air circulating along the duct part, a steam part configured to supply steam into the drum, and a controller configured to control the drum, the circulation fan, the compressor and the steam part.

The controller may maintain the rotation of the drum and stop the rotation of the circulation fan when steam is sprayed from the steam part.

When the steam part is operated, the controller may stop driving the compressor.

The controller may increase an internal temperature of the drum by driving the compressor, wherein, after a temperature of the compressor is increased to a preset drying temperature, the controller may operate the steam part to supply steam into the drum.

After supplying the steam into the drum by operating the steam part, the controller may re-drive the compressor.

The controller may rotate the circulation fan after supplying water for generation of steam to the steam part.

The controller may drive the compressor after supplying water for generation of steam to the steam part.

The controller may rotate the circulation fan at a preset first drying speed for a preset drying time, and then accelerate the circulation fan to a preset second drying speed.

Based on a temperature of the compressor being greater than or equal to a preset drying temperature, the controller may increase a rotational speed of the circulation fan from the second drying speed to a preset third drying speed.

In another aspect of the present invention, a method of controlling a laundry dryer for generating high-temperature steam through a steam part and controlling each of rotation of a drum and rotation of a circulation fan may include a steam drying procedure drying operation of increasing an internal temperature of the drum to dry an object to be dried, a steam drying procedure steam supply operation of supplying steam into the drum after the steam drying procedure drying operation, and a re-drying operation of supplying hot air into the drum after the steam drying procedure steam supply operation.

The steam drying procedure steam supply operation may include a steam drying procedure steam preheating operation of heating water for a preset preheating time by applying power to the steam part, and a steam drying procedure steam spraying operation of spraying steam generated from the steam part after the steam drying procedure steam preheating operation.

In the steam drying course steam spraying operation, the rotation of the circulation fan may be stopped.

In the steam drying procedure drying operation, the compressor may be driven at a preset operating frequency.

In the steam drying procedure drying operation, the circulation fan and the drum may be rotated.

The steam drying procedure drying operation may include a first drying operation of driving the circulation fan at a preset first drying speed, and a second drying operation of increasing a rotational speed of the circulation fan from the first drying speed to a preset second drying speed and driving the circulation fan.

The steam drying course drying operation may further include a third drying operation of accelerating a rotational speed of the circulation fan from the second drying speed to a preset third drying speed.

In the first drying operation, the circulation fan may be driven for a preset drying time.

In the steam drying procedure drying operation, when a discharge temperature of the compressor is higher than or equal to a preset drying temperature, the third drying operation may be performed.

In the steam drying procedure steam spraying operation, steam may be sprayed from the steam part by a preset spray amount.

The control method of the laundry dryer according to the present disclosure may further include a procedure inputting operation of inputting a control input for performing a steam drying procedure for preventing damage to the object to be dried and enhancing sterilization of the object, the procedure inputting operation being performed before the steam drying procedure drying operation.

In the procedure inputting operation, a control input for a first steam drying procedure or a second steam drying procedure may be input according to a material of the object to be dried.

In the steam drying procedure steam spraying operation, when the second steam drying procedure is input, a spray amount of steam may be less than a spray amount of steam in the first steam drying procedure.

In the re-drying operation, when the second steam drying procedure is input, a time for supplying hot air into the drum may be shorter than a time for supplying hot air into the drum in the first steam drying procedure.

The preheating time may be set to be longer than or equal to a time required for the water to reach a boiling point.

The controller may stop driving the compressor when operating the steam generator.

After supplying steam into the drum by operating the steam part, the controller may drive the compressor to increase an internal temperature of the drum, wherein, based on the internal temperature of the drum rising to a preset sterilization temperature, the controller may re-operate the steam part to supply steam into the drum.

After re-operating the steam part to supply the steam into the drum, the controller may drive the compressor at a preset safety frequency.

The controller may measure the temperature inside the duct part, and control an operating frequency of the compressor according to the temperature inside the duct part measured to maintain the temperature inside the duct part.

After maintaining the temperature inside the duct part above the sterilization temperature for a preset temperature maintenance time, the controller may terminate the driving of the compressor.

The controller may operate the steam part for a preset preheating time to heat water for generation of steam.

The controller may rotate the circulation fan for the preheating time, and stop rotating the circulation fan when steam is sprayed from the steam part.

In another aspect of the present invention, a method of controlling a laundry dryer for generating high-temperature steam through a steam generator and controlling each of rotation of a drum and rotation of a fan may include a sterilization steam heating operation of supplying steam into the drum, a sterilization drying operation of increasing an internal temperature of the drum supplied with the steam, a steam re-sterilization operation of supplying steam into the drum after the sterilization drying operation, and a temperature maintenance operation of maintaining the internal temperature of the drum for a preset maintenance time after the steam re-sterilization operation.

The sterilization steam heating operation may include a sterilization steam preheating operation of heating water for a preset preheating time by applying power to the steam part, and a sterilization steam spraying operation of spraying the steam generated from the steam part after the sterilization steam preheating operation.

In the steam preheating operation, the circulation fan and the drum may be rotated.

In the steam spraying operation, rotation of the circulation fan may be stopped.

In the sterilization drying operation, the compressor may be driven at a preset operating frequency.

In the sterilization drying operation, the circulation fan and the drum may be rotated.

In the steam re-sterilization operation, rotation of the circulation fan may be stopped.

The temperature maintenance operation may include a reheating operation of driving the compressor at a preset safety frequency.

The temperature maintenance operation may further include a heating control operation of measuring a temperature inside the duct part after the reheating operation and changing the operating frequency of the compressor according to the temperature inside the duct part.

In the temperature maintenance operation, the circulation fan and the drum may be rotated.

The preheating time may be set to be longer than or equal to a time required for the water to reach a boiling point.

In the sterilization drying operation, when an internal temperature of the drum rises to a preset sterilization temperature, the driving of the compressor may be stopped and the steam re-sterilization operation may be performed.

As is apparent from the above description, according to a laundry dryer and a control method of the laundry dryer according to the present disclosure, a drum and a circulation fan may each be provided with a motor, and rotation of each of the drum and the circulation fan may be controlled. Thereby, steam may be evenly supplied to an object to be dried by rotating the drum while spraying steam.

In addition, when a course starts, heating is started while spraying high-temperature steam onto the object to be dried. Accordingly, the temperature of the object may be raised to a temperature required for sterilization while maintaining moisture in the object.

In addition, a high enthalpy may be transferred to the object to be dried through the process of spraying steam after drying and performing re-drying. Accordingly, bacteria may be removed by a high amount of heat.

In addition, by alternately operating a compressor and a steam generator, a malfunction or power cut-off may be prevented when an instantaneous increase in power use occurs.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
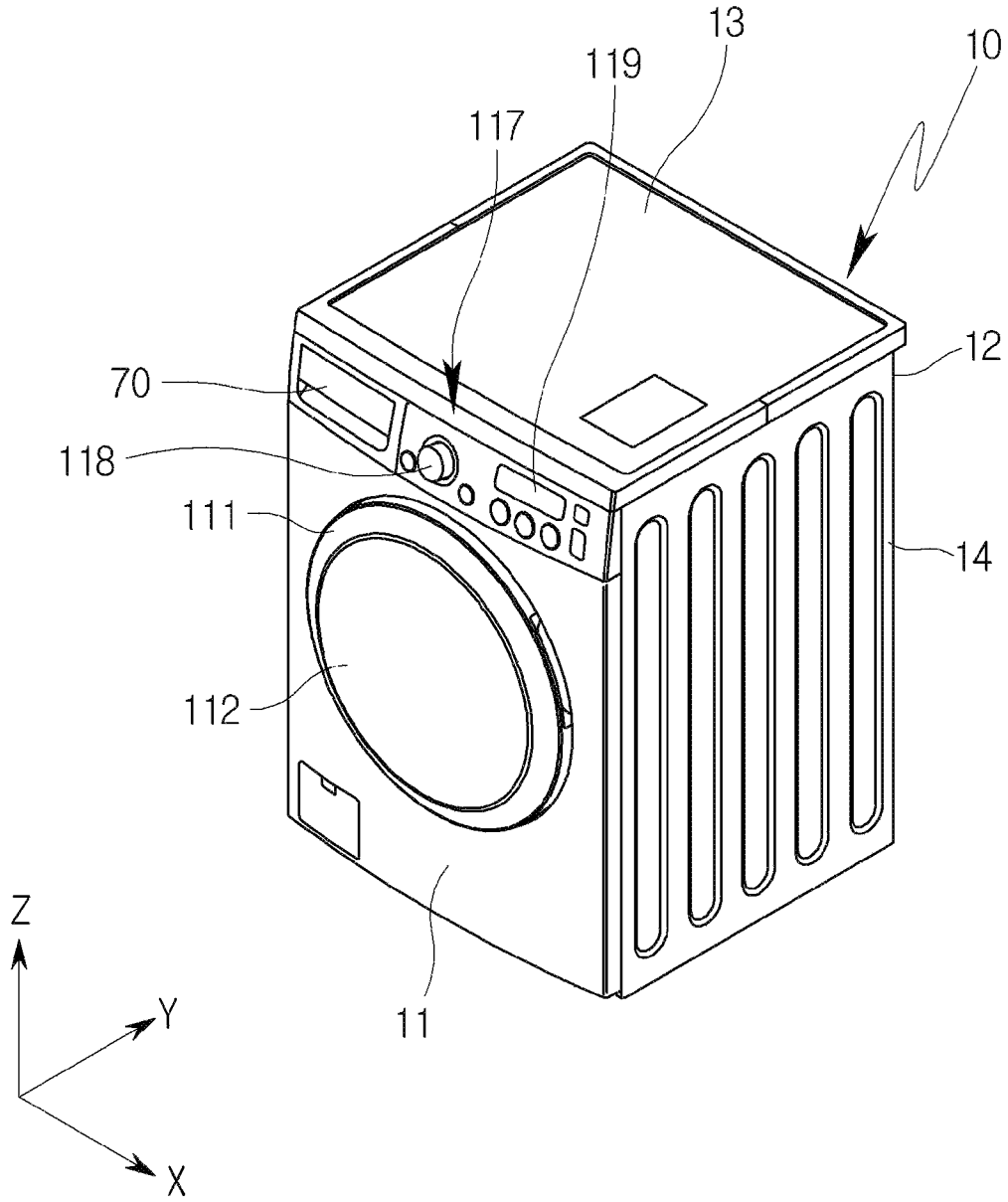
FIG. 1 is a view illustrating an outer appearance of a laundry dryer according to an embodiment of the present disclosure.

Hereinafter, exemplary embodiments of the present disclosure will be described in detail with reference to the accompanying drawings.

The present disclosure may be subjected to various changes and may have various embodiments, and specific embodiments will be described in detail with reference to the accompanying drawings. This is not intended to limit the present disclosure to the specific embodiments, and should be construed as including all changes, equivalents, and substitutes provided they come within the scope of the appended claims and their equivalents.

Terms including ordinal numbers such as first, second, etc. may be used to explain various constituents, but the constituents may not be limited thereto. These terms are used only for the purpose of distinguishing one constituent from another. For example, without departing from the scope of the present disclosure, a first component may be referred to as a second component, and similarly, a second component may be referred to as a first component.

The term "and/or" may include a combination of a plurality of related described items or any of a plurality of related described items.

When one constituent is mentioned as being "connected" or "linked" to another constituent, it may be understood that this means the one constituent may be directly connected or linked to the other constituent or another constituent may be interposed between the constituents. On the other hand, when one constituent is mentioned as being "directly connected" or "directly linked" to another constituent, it may be understood that this means no other constituent is interposed between the constituents.

Terms used in this specification are merely adopted to explain specific embodiments, and are not intended to limit the present disclosure. A singular expression may include a plural expression unless the two expressions are contextually different from each other.

In this specification, a term "include" or "have" is intended to indicate that characteristics, figures, operations, operations, constituents, and components disclosed in the specification or combinations thereof exist. The term "include" or "have" may be understood as not precluding existence or addition of one or more other characteristics, figures, operations, operations, constituents, components, or combinations thereof.

Unless defined otherwise, all terms, including technical and scientific terms, used in this specification may have the same meaning as commonly understood by a person having ordinary skill in the art to which the present disclosure pertains. It will be further understood that terms, such as those defined in commonly used dictionaries, may be interpreted as having a meaning that is consistent with their meaning in the context of the related art and the present disclosure, and may not be interpreted in an idealized or overly formal sense unless expressly so defined herein.

The embodiments below are provided to enable those of ordinary skill in the art to more fully understand the present disclosure. It will be appreciated that for simplicity and clarity of illustration, the dimensions or shapes of some of the elements may be exaggerated.

Figure 2:
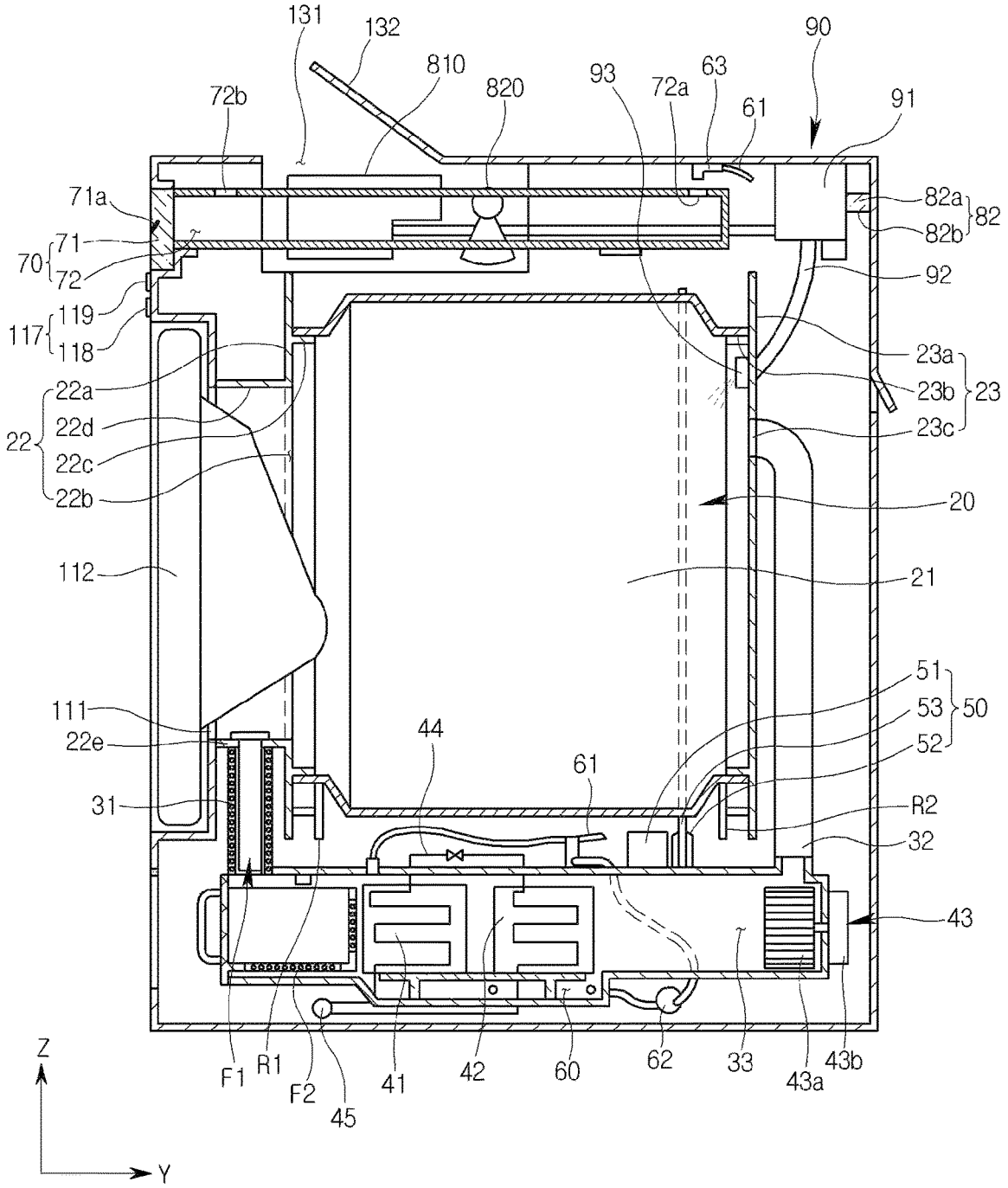
FIG. 2 is a cross-sectional view illustrating an internal structure of the laundry dryer according to the embodiment of the present disclosure.

FIG. 1 is a view illustrating an outer appearance of a laundry dryer according to an embodiment of the present disclosure, and FIG. 2 is a cross-sectional view illustrating an internal structure of the laundry dryer according to the embodiment of the present disclosure.

As shown in FIGS. 1 and 2, a cabinet 10 defining an outer body of a laundry dryer 1 includes a front panel 11 constituting a front surface of the laundry dryer 1, a rear panel 12 constituting a rear surface of the laundry dryer 1, a pair of side panels 14 constituting a side surface of the laundry dryer 1, and a top panel 13 constituting a top surface of the laundry dryer 1.

The front panel 11 may include an inlet 111 provided to communicate with a drum 20, which will be described later, and a door 112 rotatably coupled to the cabinet 10 to open and close the inlet 111.

A control panel 117 may be provided on the front panel 11.

The control panel 117 may be provided with an input unit 118 configured to receive a control command from a user, a display 119 configured to output information such as a control command selectable by the user, and a main controller (not shown) configured to control a command for performing an operation of the laundry dryer 1.

The input unit 118 may include a power supply requester configured to make a request for supply of power to the laundry dryer, a course input unit allowing the user to select a desired course among multiple courses, and an execution requester configured to request start of the course selected by the user.

The display 119 may include at least one of a display panel capable of outputting characters and/or figures, or a speaker capable of outputting a voice signal and a sound. The user may easily identify the status of the current operation and the remaining time through the information output through the display 119.

The cabinet 10 is provided therein with a drum 20 rotatably arranged and configured to provide a space to accommodate clothes (objects to be dried), a duct part 30 defining a flow path to resupply air discharged from the drum 20 back to the drum 20, and a heat exchanger 40 configured to dehumidify and heat air introduced into the duct part 30 and then resupply the air to the drum 20. That is, the duct part 30 may circulate the air inside the drum 20. The heat exchanger 40 may be disposed inside the duct part 30 to dehumidify and heat the air circulating through the duct part 30 by heat exchange with the circulating air.

The drum 20 may include a cylindrical drum body 21 with an open front surface. The cabinet 10 may be provided therein with a first support part 22 rotatably supporting the front surface of the drum body 21, and a second support part 23 rotatably supporting the rear surface of the drum body 21.

The first support part 22 may include a first fixed body 22*a* fixed to an inside of the cabinet 10, a drum inlet 22*b* formed through the first fixed body 22*a* in a penetrating manner to allow the inlet 111 communicate with the inside of the drum body 21, and a first support body 22*c* provided to the first fixed body 22*a* and inserted into the front surface of the drum body 21.

The first support part 22 may further include a connection body 22*d* connecting the inlet 111 and the drum inlet 22*b*. As shown in the figures, the connection body 22*d* may be formed in a pipe shape extending from the drum inlet 22*b* toward the inlet 111. In addition, the connection body 22*d* may be provided with an air outlet 22*e* communicating with the duct part 30.

As shown in FIG. 2, the air outlet 22*e* is a passage that allows the inside the drum body 21 to move to the duct part 30 therethrough, and may be provided as a through hole formed through the connection body 22*d* in a penetrating manner.

The second support part 23 includes a second fixed body 23*a* fixed to the inside of the cabinet 10, and a second support body 23*b* provided to the second fixed body 23*a* and inserted into the rear surface of the drum body 21.

The second support part 23 is provided with an air inlet 23*c* formed through the second fixed body 23*a* in a penetrating manner to allow the inside of the drum body 21 to communicate with the inside of the cabinet 10 therethrough.

In this case, the duct part 30 is configured to connect the air outlet 22*e* and the air inlet 23*c*.

The cylindrical drum body 21 may rotate through various types of driving units 50.

For example, in the embodiment shown in FIG. 2, the driving unit 50 includes a drum motor 51 fixed inside the cabinet 10, a pulley 52 rotated by the drum motor 51, and a belt 53 connecting a circumferential surface of the pulley 52 and a circumferential surface of the drum body 21.

In this case, the first support part 22 may be provided with a first roller R1 rotatably supporting the circumferential surface of the drum body 21, and the second support part 23 may be provided with a second roller R2 rotatably supporting the circumferential surface of the drum body 21.

However, the present disclosure is not limited thereto. A direct drive type driving unit in which the drum motor 51 is directly connected to the drum to rotate the drum without a pulley and belt may be employed, which also falls within the scope of the present disclosure. For simplicity, the following description will be made based on the illustrated embodiment of the driving unit 50.

The duct part 30 includes an exhaust duct 31 connected to the air outlet 22*e*, a supply duct 32 connected to the air inlet 23*c*, and a connection duct 33 connecting the exhaust duct 31 and the supply duct 32. The heat exchanger 40 is installed in the connection duct 33.

Various devices capable of sequentially performing dehumidification and heating of the air introduced into the duct unit 30 may be provided as the heat exchanger 40. For example, a heat pump system may be provided as the heat exchanger 40.

As the heat pump system is employed, the heat exchanger 40 may include a circulation fan 43 configured to move air along the duct part 30, a first heat exchanger (heat absorber) 41 configured to perform a dehumidification function by lowering the humidity of the air introduced into the duct part 30, and a second heat exchanger (heat generator) 42 provided inside the duct part 30 to heat the air passed through the first heat exchanger 41.

The circulation fan 43 includes an impeller 43*a* arranged inside the duct part 30 and an impeller motor 43*b* configured to rotate the impeller 43*a*. The circulation fan 43 provides flow power to air moving along the duct part 30. This is because suction force for air movement may be generated through rotation of the impeller 43*a*.

The impeller (43*a*) may be installed at any position among the exhaust duct 31, the connection duct 33, and the supply duct 32. While FIG. 2 illustrate that the impeller 43*a* is arranged in the connection duct 32, the present disclosure is not limited thereto. For simplicity, it will be assumed in the following description that the impeller 43*a* is arranged in the connection duct 32.

The heat exchanger 40 may perform heat exchange with air circulated along the duct part 30.

The heat absorber 41 and the heat generating part 42, which are inside the connection duct 33, are sequentially arranged in a direction from the exhaust duct 31 to the supply duct 32, and are connected to each other through a refrigerant pipe 44 defining a circulation passage of a refrigerant.

The heat absorber 41 is a means to cool the air and evaporate the refrigerant by transferring heat of the air introduced into the exhaust duct 31 to the refrigerant.

The heat generator 42 is a means to heat the air and condense the refrigerant by transferring heat of the refrigerant passed through the compressor 45 to the air.

The compressor 45 compresses the refrigerant performing heat exchange with the air circulated along the duct 30, through rotational power provided by a compressor motor 45*a*.

In this case, when the moisture contained in the air passes through the heat absorber 41, it moves along the surface of the heat absorber 41 and is collected on the bottom surface of the connection duct 33.

A configuration already known in the art may be applied as a configuration of the above-described heat exchanger 40 of the heat pump system type including the heat absorber 41 and the heat generator 42, and a description of details thereof will be omitted.

In order to collect water condensed from the air passing through the heat absorber 41 and formed on the bottom surface of the connection duct 33, the laundry dryer 1 according to the present disclosure includes a water collector 60.

The condensed water formed through the heat absorber 41 may be first collected in the water collector 60 and then secondly collected in a water reservoir 70. The water collector 60 may be disposed inside the connection duct 33 as shown in the figure, or may be separately provided in a space spaced apart from the connection duct 33.

The condensed water first collected through the water collector 60 is supplied to the water reservoir 70 through a condensed water supply pipe 61. Here, the condensed water supply pipe 61 is provided with a condensed water pump 62 for smooth discharge of the condensed water.

The water reservoir 70 includes a water storage tank 72 arranged to be withdrawn from one side of the front panel 11 to the outside. The water storage tank 72 is configured to collect the condensed water transferred from the water collector 60, which will be described later.

The user may withdraw the water storage tank 72 from the cabinet 10 to remove the condensed water, and then mount the same in the cabinet 10 again. Accordingly, the laundry dryer according to the present disclosure may be disposed even at a place where a sewer or the like is not installed.

More specifically, the water reservoir 70 may include a water storage tank 72 detachably provided in the cabinet 10 to provide a space for storing water, and an inlet 72*a* formed in the water storage tank 72 in a penetrating manner to introduce water discharged from the condensed water supply pipe 61 into the water storage tank 72.

The water storage tank 72 may be provided as a drawer-type tank configured to be withdrawn from the cabinet 10. In this case, the front panel 11 of the cabinet is provided with a water reservoir mounting hole into which the water storage tank 72 is inserted.

A panel 71 may be fixed to the front surface of the water storage tank 72. The panel 71 may be detachably coupled to the water reservoir mounting hole so as to form a part of the front panel 11.

The panel 71 may include a groove 71*a* into which the user's hand is inserted to grip the panel. In this case, the panel 71 also serves as a handle for withdrawing the water storage tank 72 from the cabinet or inserting the same into the cabinet.

The inlet 72*a* is formed to receive the condensed water discharged from a condensed water nozzle 63, which is fixed to the cabinet 10. The condensed water nozzle 63 may be fixed to the top panel 13 of the cabinet 10 such that the water storage tank 72 is positioned above the inlet 72*a* when the water storage tank 72 is inserted into the cabinet 10.

The user may dispose of water inside the water storage tank 72 by turning or tilting the water storage tank 72 toward the position of the inlet 72*a* after withdrawing the water storage tank 72 from the cabinet 10. A communication hole 72*b* may be further provided in the top surface of the water storage tank 72 in a penetrating manner such that the water inside the water storage tank 72 may be easily discharged through the inlet 72*a*.

The laundry dryer 1 according to the present disclosure includes a first filter F1 and a second filter F2 as means to remove foreign substances such as lint and dust produced in the operation of drying laundry such as clothes.

The first filter F1 is provided in the exhaust duct 31 to primarily filter out foreign substances contained in the air discharged from the drum 20.

The second filter F2 is disposed downstream of the first filter F1 in the flow direction of air to secondarily filter out foreign substances contained in the air reaching through the first filter F1. More specifically, as shown in the figure, the second filter F2 may be disposed upstream of the first heat exchanger 41 inside the connection duct 33. This is intended to prevent foreign substances contained in the air from accumulating in the first heat exchanger 41, which operates as a heat absorber, and contaminating the first heat exchanger 41 or causing performance degradation.

As for the detailed configuration of the first filter F1 and the second filter F2, any means known in the art may be applied, and thus a description of the detailed configuration will be omitted.

The laundry dryer 1 according to the present disclosure further includes a water supplier 80 including an internal water supplier 81 and an external water supplier 82, and a steam part 90 configured to generate steam from water supplied thereto.

The steam part 90 may be configured to generate steam from fresh water supplied thereto instead of condensed water. The steam part 90 may be configured to generate steam by heating, ultrasonic waves, or evaporation.

The steam part 90 may be controlled to receive water through the external water supplier 82 as well as the internal water supplier 81 as needed and to supply the steam into the drum body 21.

The external water supplier 82 may include a direct water valve 82*a* adjacent to the rear panel 13 or fixed to the rear panel 13, and a direct water pipe 82*b* for supplying water delivered through the direct water valve 82*a* to the steam part 90.

The direct water valve 82*a* may be coupled to an external water supply source. For example, the direct water valve 82*a* may be coupled to a water supply pipe (not shown) extending to the rear surface of the cabinet. Accordingly, the steam part 90 may receive water directly through the direct water valve 82*a*.

Accordingly, even when the internal water supplier 81 is omitted or there is no water stored in the internal water supplier 81, water for steam generation may be supplied to the steam part 90 through the direct water valve 82*a* when necessary.

The direct water valve 82*a* may be directly controlled by a controller 100.

The controller 100 may be installed on the control panel 117, or may be provided as a separate control panel, as shown in FIG. 1, to prevent the control panel 117 from being overloaded and avoid increasing manufacturing cost.

In this case, the controller 100 may be arranged adjacent to the steam part 90. The controller 100 may be arranged on the side panel 14, on which the steam part 90 is installed, thereby reducing the length of a control line connected to the steam part 90.

The steam part 90 may be arranged adjacent to the direct water valve 82*a*. Accordingly, water may be prevented from unnecessarily remaining in the direct water pipe 82*b*, and may be immediately supplied when necessary.

The controller 100 is configured to control the operation of the laundry dryer 1 based on a user's input provided through the input unit 118. The controller 100 may include a printed circuit board and elements mounted on the printed circuit board. When the user selects a clothes treatment procedure through the input unit 118 and inputs a control command for operation of the laundry dryer 1 or the like, the controller 100 may control the operation of the laundry dryer 1 according to a preset algorithm.

In the present disclosure, details of the control operation of the controller 100 will be described later.

Figure 3:
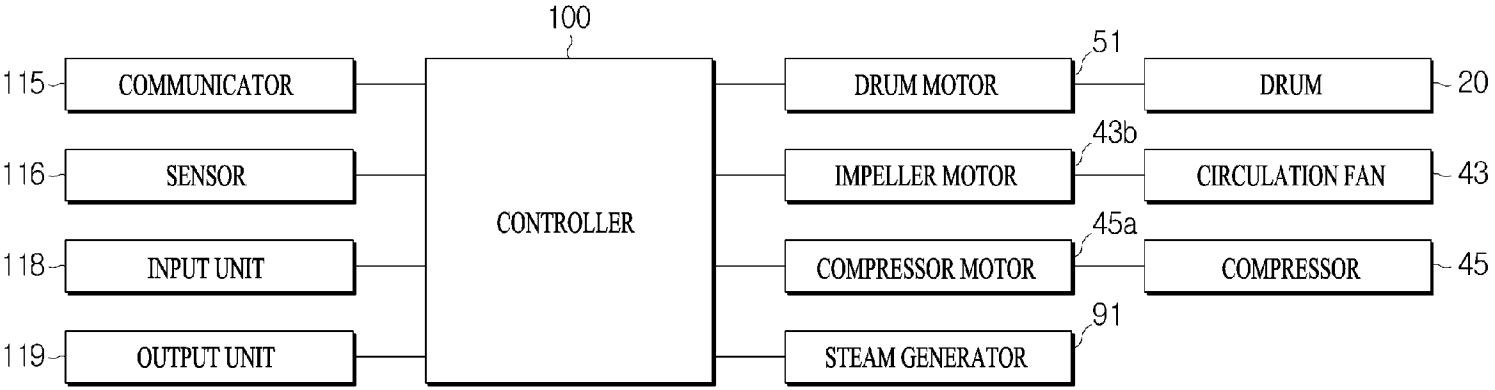
FIG. 3 is a block diagram illustrating a control configuration in the laundry dryer according to the embodiment of the present disclosure.

FIG. 3 is a block diagram illustrating a control configuration in the laundry dryer according to the embodiment of the present disclosure.

Referring to FIGS. 1 to 3, the laundry dryer 1 according to the embodiment of the present disclosure may include at least one of the input unit 118, an output unit 119, a communicator 115, a sensor 116, and motors 51, 43*b*, and 45*a*, the steam part 90, or the controller 100.

The input unit 118 may receive a control command related to operation of the laundry dryer 1 from a user. The input unit 118 may include multiple buttons or include a touch screen.

Specifically, the input unit 118 may be configured in a form capable of receiving a selection of an operation procedure of the laundry treatment apparatus or receiving a control input related to execution of the selected operation procedure.

The output unit 119 may output information related to the operation of the laundry dryer 1. The output unit 119 may include at least one display.

The information output by the output unit 119 may include information related to the operation status of the laundry dryer 1. That is, the output unit 119 may output information related to at least one of a selected operation procedure, a failure status, an operation completion time, or the amount of laundry accommodated in the drum 20.

For example, the output unit 119 may be a touch screen integrated with the input unit 118.

The communicator 115 may communicate with an external network. The communicator 115 may receive a control command related to operation of the laundry treatment apparatus over the external network. For example, the communicator 115 may receive an operation control command for the laundry dryer sent from an external terminal over the external network.

Thereby, the user may remotely control the laundry dryer.

In addition, the communicator 115 may transmit information related to a result of operation the laundry treatment apparatus to a predetermined server over the external network.

The communicator 115 may also communicate with other electronic devices in order to establish an Internet of Things (IOT) environment.

The sensor 116 may sense information related to the operation of the laundry dryer.

Specifically, the sensor 116 may include at least one of a current sensor, a voltage sensor, a vibration sensor, a noise sensor, an ultrasonic sensor, a pressure sensor, an infrared sensor, a visual sensor (camera sensor), an electrode sensor, or a temperature sensor.

As an example, the current sensor of the sensor 116 may sense electric current flowing through a point in the control circuit of the laundry dryer 1.

As another example, the temperature sensor of the sensor 116 may sense the temperature inside the duct part 30, and may sense the temperature inside the drum 20 according to an embodiment.

As another example, the electrode sensor of the sensor 116 may sense moisture inside the drum 20.

The sensor 116 may include one or more temperature sensors configured to sense the temperature of the heat exchanger 40 and transmit the sensing result to the controller 100.

As an example, the sensor 116 may include one or more temperature sensors to sense at least one of temperatures of air and a refrigerant circulating in each of the first heat exchanger 41 and the second heat exchanger 42.

As another example, the sensor 116 may include one or more temperature sensors to sense the temperature of the refrigerant circulating in the compressor 45. In order to sense the temperature of the compressor 45, a thermistor may be installed at a portion of the compressor from which the refrigerant is discharged. Thereby, the discharge temperature of the compressor may be measured.

The sensor 116 may further include multiple temperature sensors configured to sense the temperature of air flowing into or out of the drum 20.

The sensor 116 including the multiple temperature sensors may include a temperature sensing module provided to the heat exchanger 40, and a sensing module provided to the controller 100 to receive sensing results from the multiple temperature sensors to sense temperatures.

As described above, the sensor 116 may include at least one of various types of sensors, and the types of sensors included in the laundry dryer 1 are not limited. In addition, the number or installation locations of the sensors may be designed differently according to the purpose.

The motors 51, 43*b*, and 45*a* include a drum motor 51, an impeller motor 43*b*, and a compressor motor 45*a*, and may change at least one of power, current, voltage, or speed according to a control command (instruction) of the controller 100.

For example, the drum motor 51 may change the rotational speed (revolutions per minute (rpm)) of the drum 20 according to a control command from the controller 100.

As another example, the impeller motor 43*b* may change the rotational speed (rpm) of the circulation fan 43 according to a control command from the controller 100.

As another example, the compressor motor 45*a* may change the frequency (in Hz) of the compressor 45 according to a control command from the controller 100.

The steam part 90 may be controlled to receive water through the external water supplier 82 as well as the internal water supplier 81 as needed to supply steam into the drum body 21.

The steam part 90 may include a steam generator 91 configured to generate steam by heating supplied water, a steam pipe 92 allowing the generated steam to flow therethrough, and a steam nozzle 93 configured to spray the steam into the drum body 21.

As an example, the steam generator 91 is described as generating steam by heating a specific amount of water accommodated therein with a heater (not shown) (hereinafter, this method will be referred to as "whole heating" for simplicity), but is not limited thereto.

The controller 100 may control components included in the laundry dryer 1.

First, the controller 100 may generate at least one of a power command value, a current command value, a voltage command value, or a speed command value in order to control rotation of the drum motor 51, the impeller motor 43*b*, and the compressor motor 45*a*.

In the present disclosure, the controller 100 may control each of the drum motor 51, the impeller motor 43*b*, and the compressor motor 45*a* individually.

Accordingly, the controller 100 may control the operation of at least one of the drum 20, the circulation fan 43, or the heat exchanger 40 based on the control input that is input through the input unit 118.

That is, the controller 100 may control the rotational speed and rotation pattern of the drum 20 based on a control input that is input by the user through the input unit 118. The controller 100 may also control the rotational speed or operation timing of the circulation fan 43 based on a control input that is input by the user through the input unit 118.

In addition, the controller 100 may control the heat exchanger 40 to adjust the temperature inside the drum 20 based on a control input that is input by the user through the input unit 118.

For example, the controller 100 may control a driving (operation) frequency (in Hz) of the compressor 45 based on a control input that is input by the user through the input unit 118.

In addition, the controller 100 may generate at least one of a power command value, a current command value, or a voltage command value in order to control the operation of the steam generator 91.

That is, the controller 100 may control the heating time of the steam generator 91 based on a control input that is input by the user through the input unit 118.

In this case, the controller 100 may adjust the heating time of the steam generator 91 based on information such as an external temperature or the amount of laundry.

In the case of a conventional laundry dryer, the drum and the circulation fan are connected to one motor. Thus, the drum and circulation fan are rotated at the same time and stopped at the same time.

In this case, when steam is sprayed into the laundry dryer, the rotation of the circulation fan needs to be stopped to sufficiently supply the sprayed steam to objects to be dried, and the rotation of the drum is also stopped to stop the circulation fan.

However, once the rotation of the drum is stopped, the objects to be dried cannot be turned over. Even when steam is supplied to the objects to be dried, the steam is supplied only to objects placed on the side facing the sprayed steam. Accordingly, the conventional laundry dryer has limitation in evenly supplying steam to the entire objects.

In order to address this issue, the drum motor 51 and the impeller motor 43*b* are separately provided in the laundry dryer 1 according to the embodiment of the present disclosure. In addition, the controller 100 may control each of the drum motor 51, the impeller motor 43*b*, and the compressor motor 45*a* individually.

Accordingly, when steam is sprayed from the steam part 90, the controller 100 according to the embodiment of the present disclosure may stop the rotation of the circulation fan 43 while maintaining the rotation of the drum 20.

In addition, the controller 100 of the present disclosure may stop driving of the compressor 45 in operating the steam part 90 in order to prevent power supply from being cut off due to an instantaneous increase in power consumption of the entire laundry dryer 1.

Specifically, the controller 100 may stop the rotation of the compressor motor 45*a* when it operates the steam generator 91 to preheat water or generate steam.

That is, the controller 100 may drive the compressor 45 to increase the internal temperature of the drum 20. After the temperature of the compressor 45 is increased to a preset drying temperature Td, the controller 100 may stop driving the compressor 45, and operate the steam part 90 to supply steam into the drum 20.

In addition, after supplying steam into the drum 20 by operating the steam part 90, the controller 100 may stop operating the steam part 90 and re-drive the compressor 45 to dry the objects to be dried again.

The control of the controller 100 over time will be described later with reference to FIGS. 4 to 5B.

Figure 4:
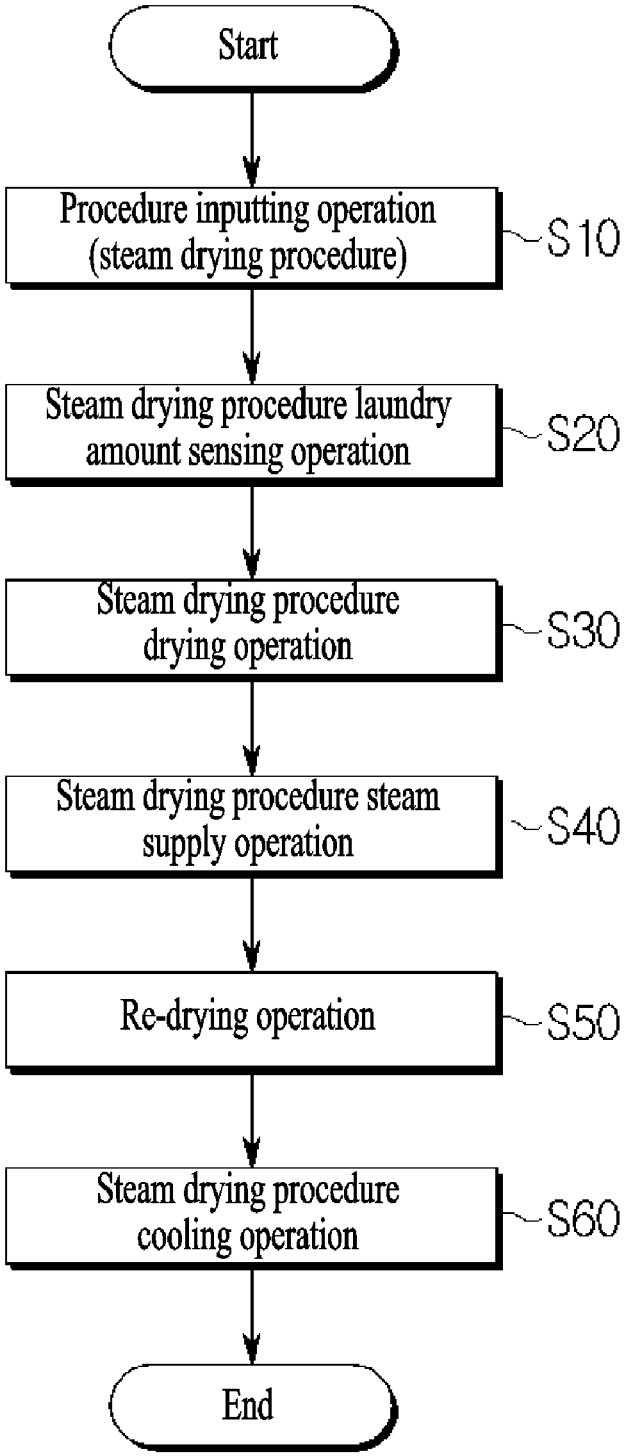
FIG. 4 is a flowchart illustrating a procedure according to a control method of the laundry dryer according to one embodiment of the present disclosure.
Figure 5A:
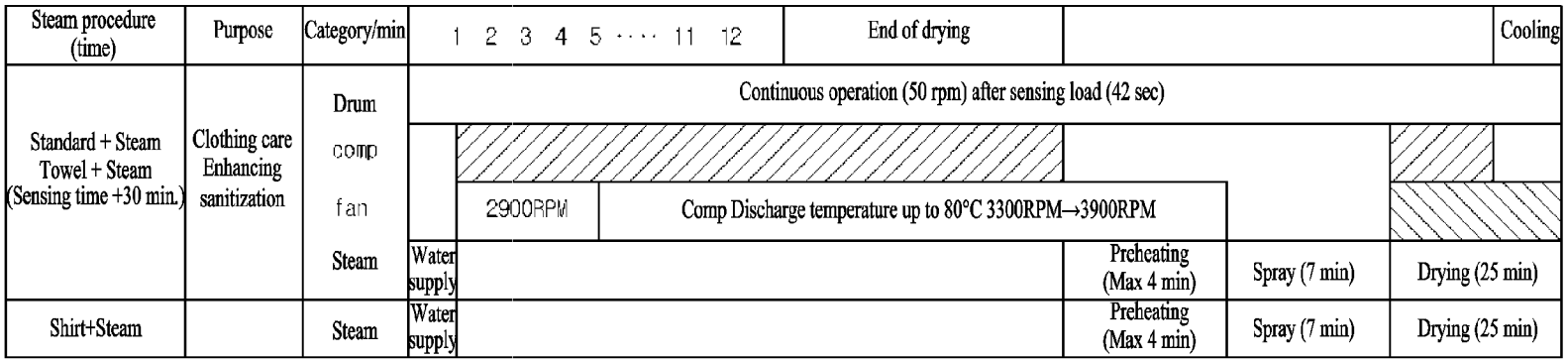
FIGS. 5A and 5B illustrate an example of a first steam drying procedure and a second steam drying procedure according to a specific application example of a steam drying method related to one embodiment of the present disclosure.
Figure 5B:
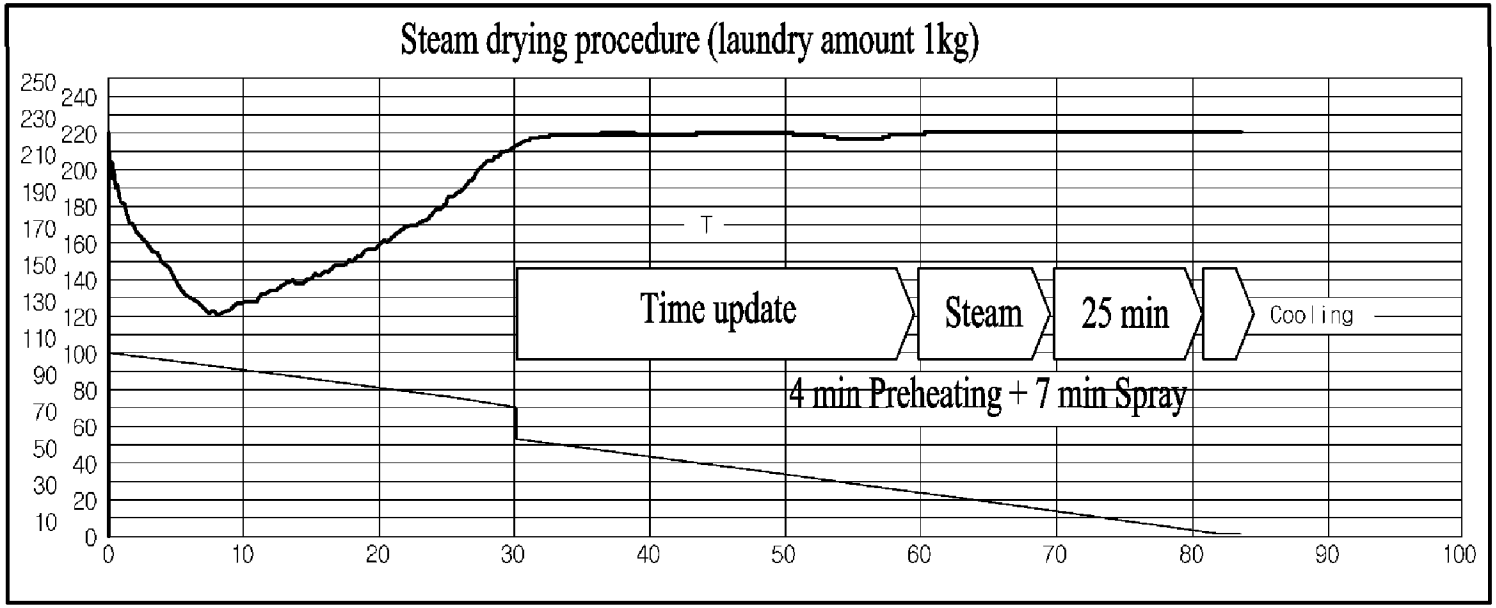

FIG. 4 is a flowchart illustrating a procedure according to a control method of the laundry dryer 1 according to one embodiment of the present disclosure, and FIGS. 5A and 5B illustrate an example of a first steam drying procedure and a second steam drying procedure according to a specific application example of a steam drying method related to one embodiment of the present disclosure.

Referring to FIGS. 1 to 5B, a control method of the laundry dryer 1 according to one embodiment of the present disclosure is configured as follows.

The control method of the laundry dryer 1 according to the embodiment of the present disclosure includes a procedure inputting operation S10, a steam drying procedure laundry amount sensing operation S20, a steam drying procedure drying operation S30, a steam drying procedure steam supply operation S40, a re-drying operation S50, and a steam drying procedure cooling operation S60.

In the procedure inputting operation S10, a control input for performing a steam drying procedure that prevents damage to objects to be dried and enhances sterilization of the objects is input.

Here, a procedure represents a program set in the clothes treatment apparatus. When a user selects one procedure, the controller may perform several operations of controlling respective components to perform the selected procedure. Thus, an operation refers a part of the program by which the operation status of a component may be distinguished to perform the procedure. Thus, one procedure may include multiple operations.

For example, the clothes treatment apparatus may have a steam drying procedure (or drying procedure) for drying, and/or a sterilization procedure for sterilization.

Specifically, in the procedure inputting operation S10, a control input for the first steam drying procedure or the second steam drying procedure may be input according to the material of an object to be dried (or clothing).

That is, when the laundry dryer 1 of the present disclosure is turned on, the user may input a control input through the input unit 118 by selecting a desired procedure. In this case, the user may input the steam drying procedure to prevent damage to the objects to be dried and enhance sterilization of the objects to be dried.

Specifically, to dry a thick or hydrophilic material with a relatively high moisture content among the materials (or laundry materials) of the objects to be dried, a first steam drying procedure (which may be called, for example, a "standard+steam procedure" or a "towel+steam procedure"). To dry a thin or hydrophobic material with a relatively low moisture content, a second steam drying procedure (which may be called a "shirt+steam procedure") may be selected.

In the present disclosure, the control of the steam drying procedure steam supply operation S40 and the re-drying operation S50, which will be described later, may vary according to a control input for the first steam drying procedure or the second steam drying procedure in the procedure inputting operation S10.

In addition, in the procedure inputting operation S10, the control of each operation may also vary according to a control input for a sterilization procedure.

In the steam drying procedure laundry amount sensing operation S20, the laundry amount of cloth to the objects to be dried may be detected through rotation of the drum 20. Generally, the laundry amount of wet clothing after dewatering will be sensed.

That is, the controller 100 may sense the load of the objects to be dried by rotating the drum 20 and sense the laundry amount of the objects to be dried through the sensed load (S21).

At this time, the controller 100 does not drive the compressor 45 (S22). In addition, the controller 100 does not rotate the circulation fan 43 (S23).

In the present disclosure, the controller 100 may supply water for generation of steam to the steam part 90 (S24).

That is, the controller 100 may cause water to be supplied from the water supplier 80 to the steam part 90. According to an embodiment, the controller 100 may operate a water supply pump provided in the internal water supplier 81 to supply water into the steam generator 91, and may open the direct water valve 82*a* provided in the external water supplier 82 to supply water into the steam generator 91.

For example, in the operation S24 of supplying water for generation of steam, water more than or equal to 150 cc and less than or equal to 250 cc may be supplied from the water supplier 80 to the steam generator 91, and the time required to supply water from the water supplier 80 to the steam generator 91 may be longer than or equal to 30 seconds and shorter than or equal to 1.

While it is described in the present embodiment that the operation S21 of sensing the laundry amount of the objects to be dried and the operation S24 of supplying water to the steam part 90 are performed simultaneously, embodiments are not limited thereto. The operation S24 of supplying water to the steam part 90 may be performed during the steam drying procedure drying operation S30, which will be described later.

In the steam drying procedure drying operation S30, the internal temperature of the drum 20 may be increased to dry the objects to be dried.

In the steam drying procedure drying operation S30, the controller 100 may set a time required to perform the steam drying procedure drying operation S30 based on the laundry amount of the objects to be dried sensed in the steam drying procedure drying operation S20.

In the present disclosure, the time required to perform the steam drying procedure drying operation S30 may be updated or shortened based on the amount of moisture sensed during the drying.

The steam drying procedure drying operation S30 may include an operation S31 of rotating the drum 20 at a pre-input reference speed Wr by the controller 100. For example, the controller 100 may continuously rotate the drum 20 at a rotational speed greater than or equal to 45 rpm and less than or equal to 55.

In addition, the steam drying procedure drying operation S30 may include an operation S32 of driving (rotating) the compressor 45 at a preset operating frequency f by the controller 100. For example, the controller 100 may drive the compressor 45 at a frequency greater than or equal to 85 Hz and less than or equal to 105 Hz.

In this operation, the controller 100 may generate a control command to increase output power for driving of the compressor 45 up to the operating frequency f at one time, or may generate a control command to increase the rotational speed of the compressor motor 45*a* in multiple stages in order to prevent the compressor motor 45*a* from being overloaded to be broken.

As an example, the controller 100 may first generate a control command for driving the compressor 45 at a frequency greater than or equal to 55 Hz and less than or equal to 65 Hz, and then generate a control command for driving the compressor 45 at a frequency greater than or equal to 75 Hz and less than or equal to 85 Hz. Then, the controller 100 may finally generate a control command for driving the compressor 45 at the operating frequency f.

The steam drying procedure drying operation S30 may include an operation S33 of rotating the circulation fan 43 by the controller 100.

Specifically, the steam drying procedure drying operation S30 may include a first drying operation S33*a* of driving the circulation fan 43 at a preset first drying speed V1, a second drying operation S33*b* of driving the circulation fan 43 by increasing the rotational speed of the circulation fan 43 from the first drying speed V1 to a preset second drying speed V2, and a third drying operation S33*c* of driving the circulation fan 43 by increasing the rotational speed of the circulation fan 43 from the second drying speed V2 to a preset third drying speed V3.

In the first drying operation S33*a*, the controller 100 may drive the circulation fan 43 at the first drying speed V1 for a predetermined drying time tc.

For example, in the first drying operation S33*a*, the controller 100 may drive (rotate) the circulation fan 43 at a speed greater than or equal to 2700 rpm and less than or equal to 3100 rpm for a time longer than or equal to 3 minutes and shorter than or equal to 5 minutes.

In the second drying operation S33*b*, the controller 100 may accelerate the circulation fan 43 to the second drying speed V2 when the drying time tc has elapsed.

For example, in the second drying operation S33*b*, the controller 100 may drive (rotate) the circulation fan 43 at a speed greater than 3100 rpm and less than or equal to 3500 rpm.

In the second drying operation S33*b*, when the discharge temperature of the compressor 45 (which may mean the temperature of the refrigerant discharged after being compressed by the compressor) is higher than or equal to a preset drying temperature Td, It the controller 100 may enter the third drying operation S33*c*. The discharge temperature may be measured through a temperature sensor (not shown) arranged adjacent to a discharge port of the compressor 45.

That is, in the third drying operation S33*c*, when the discharge temperature T of the compressor 45 is higher than or equal to the drying temperature Td (T≥Td), the control over 100 may rotate (drive) the circulation fan 45 by accelerating the rotational speed of the circulation fan 45 from the second drying speed V2 to the preset third drying speed V3.

For example, in the third drying operation S33*c*, when the discharge temperature of the compressor 45 is over a temperature range of 75° C. to 85° C., the controller 100 may accelerate the circulation fan 45 to drive (rotate) the circulation fan 45 at a speed greater than or equal to 3700 rpm and less than or equal to 4100 rpm.

In the steam drying procedure drying operation S30, the controller 100 may skip operating the steam part 90 (S34). That is, after water for steam generation is supplied to the steam part 90 in the steam drying procedure laundry amount sensing operation S20, the controller 100 may rotate the circulation fan 43 (S33) and drive the compressor 45 (S32) in the steam drying procedure drying operation S30.

Accordingly, in the steam drying procedure drying operation 30, the controller 100 may drive the drum 20, the compressor 45, and the circulation fan 43 simultaneously, and skip operating the steam part 90.

In the steam drying procedure steam supply operation S40 following the steam drying procedure drying operation S30, the controller 100 may control the steam part 90 to supply steam into the drum 20.

The steam drying procedure steam supply operation S40 may include an operation S41 of rotating the drum 20 at a pre-input reference speed Wr by the controller 100. As an example, the controller 100 may continuously rotate the drum 20 while maintaining the drum 20 at a rotational speed greater than or equal to 45 rpm and less than or equal to 55 rpm.

In the steam drying procedure steam supply operation S40, the controller 100 may stop driving the compressor 45 in order to prevent an instantaneous increase in power consumption of the laundry dryer 1 (S42).

In addition, in the steam drying procedure steam supply operation S40, the controller 100 may continuously rotate (drive) the circulation fan 43 at a rotational speed equal to the third drying speed V3 while the steam part 90 performs preheating to spray steam after the third drying operation S33*c* (S43*a*).

Then, when the steam part 90 sprays steam, the controller 100 may stop rotating the circulation fan 43 (S43*b*).

The steam drying procedure steam supply operation S40 may include a steam drying procedure steam preheating operation S44*a* and a steam drying procedure steam spraying operation S44*b*.

In the steam drying procedure steam preheating operation S44*a*, the controller 100 may apply power to the steam part 90 to heat water supplied for steam generation for a preset preheating time th.

Specifically, in the steam drying procedure steam preheating operation S44*a*, the controller 100 may heat water supplied to the steam generator 91 by applying power to a heater (not shown) provided in the steam generator 91. In this operation, the controller 100 may apply power to the heater for the preheating time th. The preheating time th may be set to be greater than or equal to a time required for the water to reach a boiling point.

For example, in the steam drying procedure steam preheating operation S44*a*, the controller 100 may generate a control command to apply power to the steam part 90 for a time longer than or equal to 3 minutes 30 seconds and shorter than or equal to 4 minutes 30 seconds.

In the steam drying procedure steam spraying operation S44*b* after the steam drying procedure steam preheating operation S44*a*, the controller 100 may spray the steam generated from the steam part 90 into the drum 20 by a preset spray amount.

Specifically, in the steam drying procedure steam spraying operation S44*b*, the controller 100 may generate a control command for the steam generator 91 such that water that is heated by the steam generator 91 and starts boiling flows through the steam pipe 92 and is sprayed into the drum body 21 through the steam nozzle 93.

In the steam drying procedure steam spraying operation S44*b*, the controller 100 may control the spray time of the steam according to whether the first steam drying procedure or the second steam drying procedure is input in the procedure inputting operation S10.

Specifically, when a control input for the first steam drying procedure is input in the procedure inputting operation S10, the controller 100 may cause the amount of water supplied in the operation S24 of supplying water for steam generation to be sprayed in the steam drying procedure steam spraying operation S44*b*.

For example, in the steam drying procedure steam spraying operation S44*b*, the controller 100 may cause water whose amount is greater than or equal to 150 cc and less than or equal to 250 cc to be sprayed from the steam generator 91 into the drum 20. In this case, the time required to spray the steam may be longer than or equal to 6 minutes 30 seconds and shorter than or equal to 7 minutes 30 seconds.

In contrast, when a control input for the second steam drying procedure is input in the procedure inputting operation S10, the controller 100 may cause a smaller amount of steam than the steam sprayed in the first steam drying procedure to be sprayed in the steam drying procedure steam spraying operation S44*b*. Specifically, when the control input for the second steam drying procedure is input in the procedure inputting operation S10, the controller 100 may cause water whose amount is less than or equal to half the amount supplied in the water supply operation S24 for steam generation to be sprayed in the steam drying procedure steam spraying operation S44*b*.

For example, in the steam drying procedure steam spraying operation S44*b*, the controller 100 may cause water whose amount is greater than or equal to 60 cc and less than or equal to 120 cc to be sprayed from the steam generator 91 into the drum 20. In this case, the time required to spray the steam may be longer than or equal to 2 minutes 30 seconds and shorter than or equal to 3 minutes 30.

Accordingly, according to the present disclosure, after removing moisture from the objects to be dried in the steam drying procedure drying operation S30, the steam drying procedure steam supply operation S40 may be performed. Thereby, the amount of heat inside the drum 20 may be increased by supply of high-temperature steam to remove bacteria that may be present in the objects to be dried. Accordingly, sanitization of the objects to be dried may be enhanced.

In addition, friction that may cause damage to the objects over-dried in the steam drying procedure drying operation S30 may be prevented by supplying moisture in the steam drying procedure steam supplying operation S40.

Further, when steam is being sprayed onto the objects to be dried, the drum 20 rotates at a constant speed, but the circulation fan 43 is not operated. Accordingly, steam may be evenly supplied to the objects to be dried.

Accordingly, as the steam is evenly supplied to the entire the objects to be dried, the entire objects to be dried may be sterilized as a whole and sanitization thereof may be enhanced.

In the re-drying operation S50 after the steam drying procedure steam supply operation S40, the controller 100 may generate a control command to supply hot air into the drum 20.

In the re-drying operation S50, the controller 100 may control the execution time of the re-drying operation S50 according to whether the first steam drying procedure or the second steam drying procedure is input in the procedure inputting operation S10.

That is, when the control input for the first steam drying procedure is input in the procedure inputting operation S10, the controller 100 may execute the re-drying operation S50 for a preset first re-drying time tr1.

For example, in the re-drying operation S50, when the control input for the first steam drying procedure has been input, the controller 100 may perform the re-drying operation S50 for a time longer than or equal to 20 minutes and shorter than or equal to 30 minutes.

When the control input for the second steam drying procedure is input in the procedure inputting operation S10, the controller 100 may execute the re-drying operation S50 for a preset second re-drying time tr2.

For example, in the re-drying operation S50, when the control input for the second steam drying procedure has been input, the controller 100 may perform the re-drying operation S50 for a time longer than or equal to 10 minutes and shorter than or equal to 20 minutes.

That is, in the re-drying operation S50, when the second steam drying procedure is input, the time tr2 required to perform the re-drying operation S50 may be shorter than the time tr1 required to perform the re-drying operation S50 in the first steam drying procedure (tr2<tr1).

The re-drying operation S50 may include an operation S51 of rotating the drum 20 at a pre-input reference speed Wr by the controller 100. For example, the controller 100 may continuously rotate the drum 20 while maintaining the drum 20 at a rotational speed that is greater than or equal to 45 rpm or less than or equal to 55 rpm.

The re-drying operation S50 may include an operation S52 of driving (rotating) the compressor 45 again by the controller 100. For example, the controller 100 may drive the compressor 45 while increasing the frequency to a frequency higher than or equal to 80 Hz and lower than or equal to 100 Hz.

In this case, the controller 100 may generate a control command to increase the rotational speed of the compressor motor 45*a* in multiple stages in order to prevent the compressor motor 45*a* from being overloaded to be broken.

As an example, the controller 100 may first generate a control command for driving the compressor 45 at a frequency greater than or equal to 55 Hz and less than or equal to 65 Hz, and then generate a control command for driving the compressor 45 at a frequency greater than or equal to 75 Hz and less than or equal to 85 Hz.

In the present embodiment, when the discharge temperature of the compressor 45 is not sufficient to sterilize the objects to be dried due to an influence of an external temperature, the controller 100 may finally generate a control command to drive the compressor 45 at a frequency higher than or equal to 90 Hz or lower than or equal to 100 Hz.

In the re-drying operation S50, the controller 100 may rotate (drive) the circulation fan 43 while maintaining the third drying speed V3 as the rotational speed of the circulation fan 43 (S53).

In the re-drying operation S50, since sufficient moisture has been supplied to the objects to be dried, the controller 100 skip (stop) operation of the steam part 90 (S54).

In the steam drying procedure cooling operation S60 after the re-drying operation S50, the controller 100 may perform a control operation to blow hot air inside the drum 20 for a pre-input blowing time to cool the objects to be dried.

For example, in the steam drying procedure cooling operation S60, the controller 100 may cool the objects to be dried by blowing hot air inside the drum 20 for a time longer than or equal to 3 minutes 30 seconds and shorter than or equal to 4 minutes 30 seconds.

The steam drying procedure cooling operation S60 may include an operation S61 of rotating the drum 20 at a pre-input reference speed Wr by the controller 100. For example, the controller 100 may continuously rotate the drum 20 while maintaining the drum 20 at a rotational speed higher than or equal to 45 rpm or lower than or equal to 55 rpm.

Then, in the steam drying procedure cooling operation S60, the controller 100 may terminate the driving of the compressor 45 to lower the temperature of the dried objects (S62).

In addition, in the steam drying procedure cooling operation S60, the controller 100 may rotate (drive) the circulation fan 43 at the third drying speed V3 as the rotational speed of the circulation fan 43 in order to blow the heated air inside the drum 20 (S63).

In the steam drying procedure cooling operation S60, since sufficient moisture has been supplied to the objects to be dried, the controller 100 may skip (stop) operating the steam part 90 (S64).

Figure 6A:
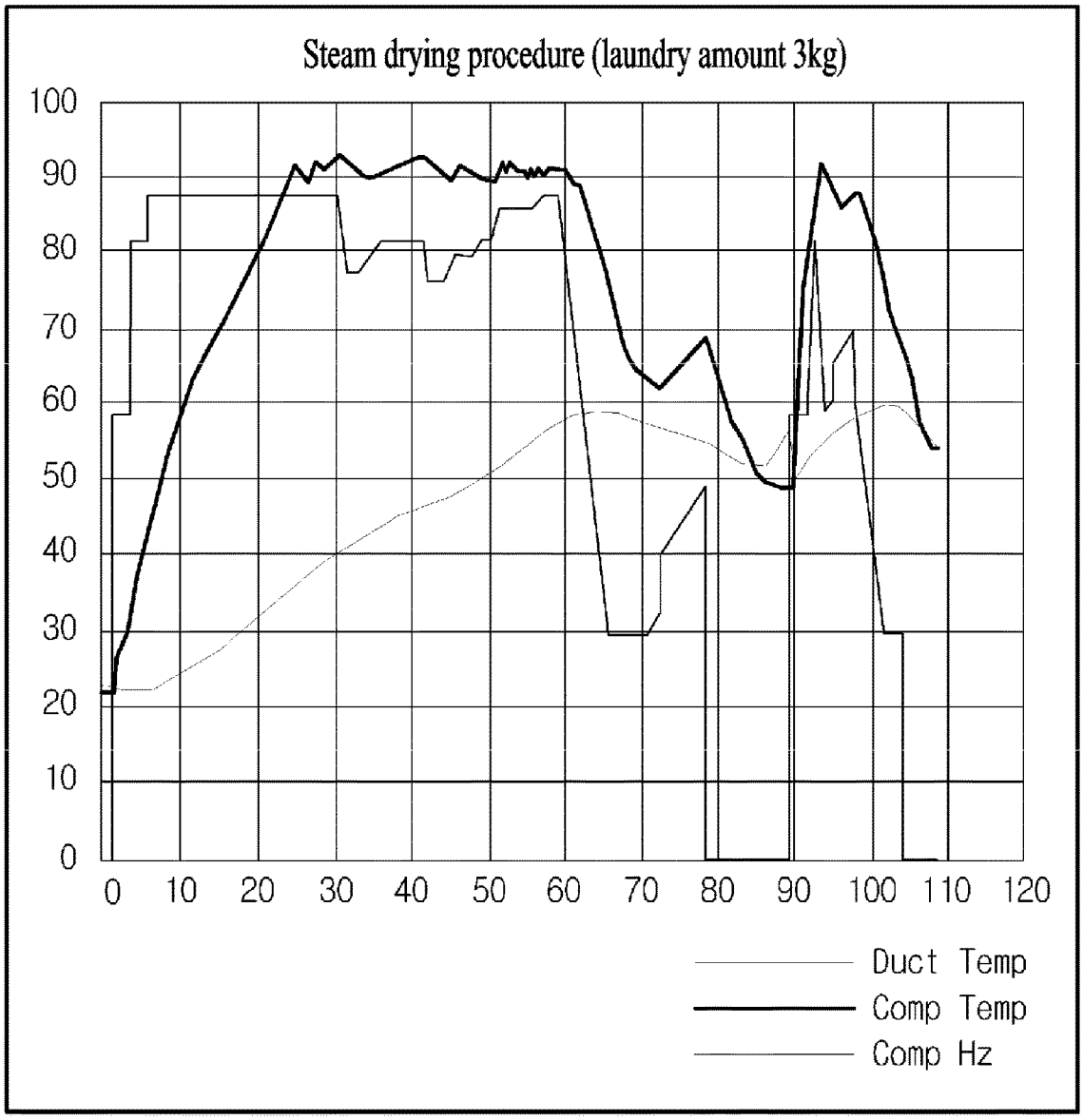
FIG. 6A exemplarily depicts a change in temperature of a duct part and a compressor under a room temperature condition according to the control method of the laundry dryer according to one embodiment of the present disclosure.
Figure 6B:
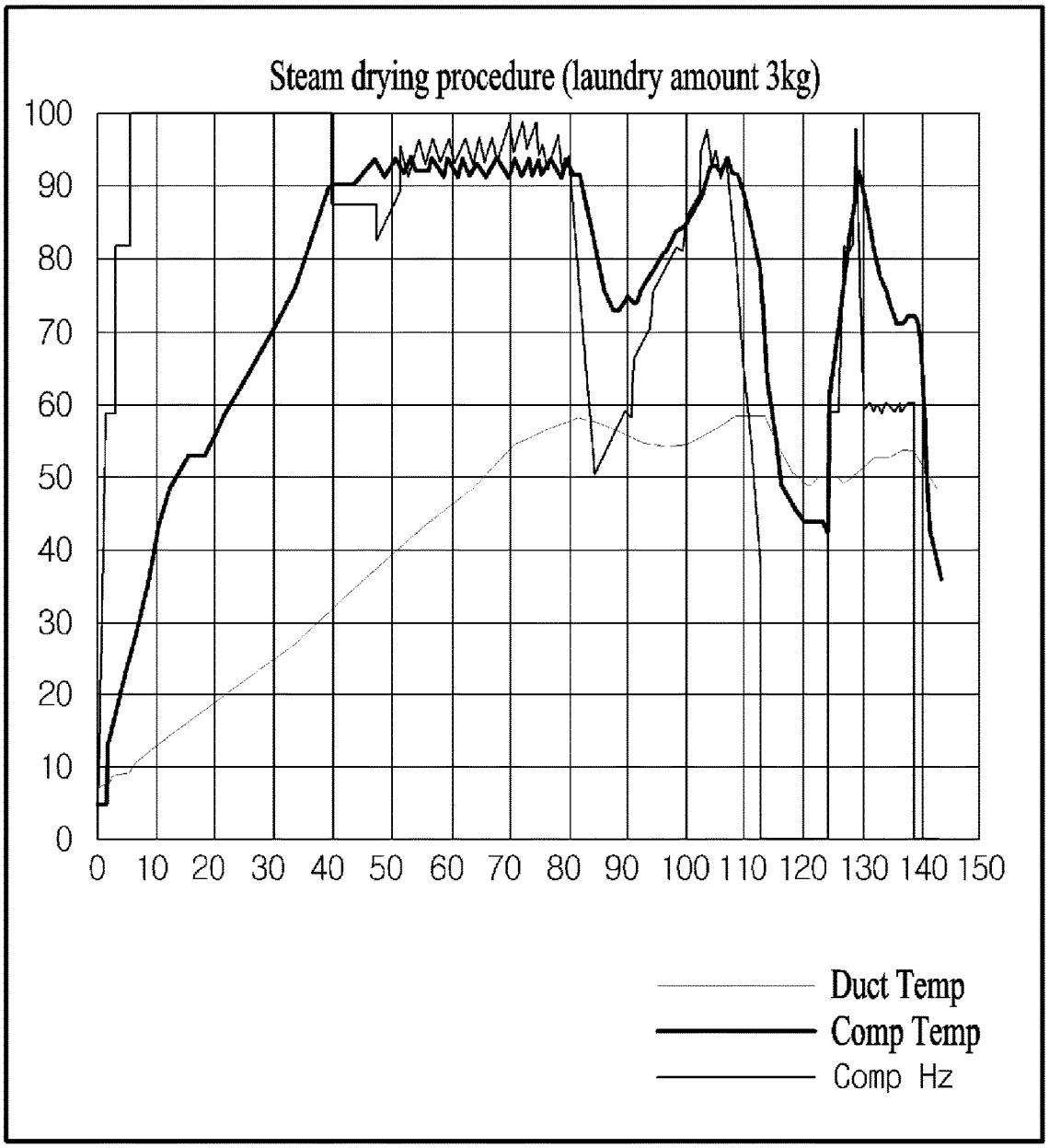
FIG. 6B exemplarily depicts a change in temperature of a duct part and a compressor under a low temperature condition according to the control method of the laundry dryer according to one embodiment of the present disclosure.
Figure 6C:
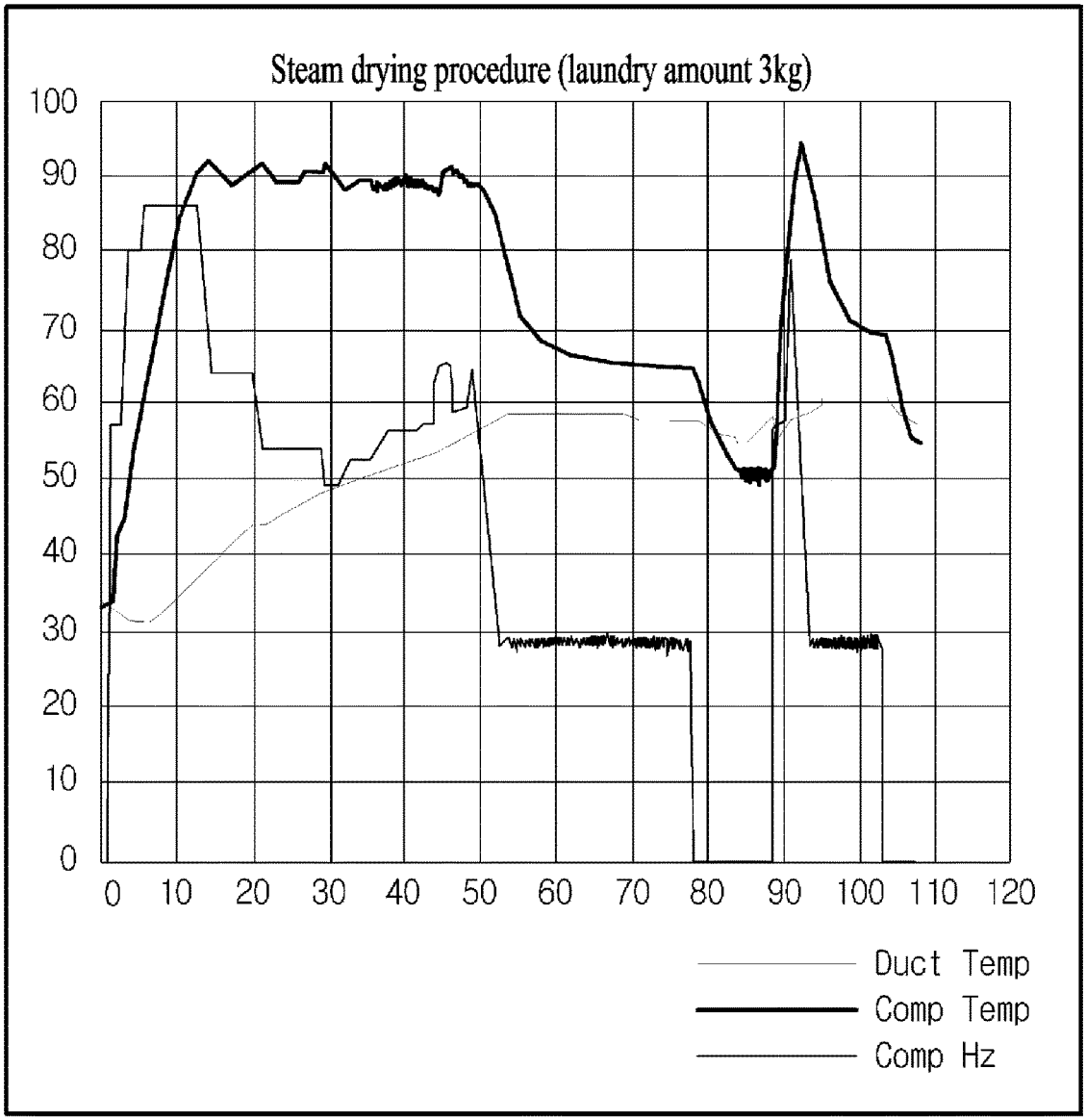
FIG. 6C exemplarily depicts a change in temperature of a duct part and a compressor under a high temperature condition according to the control method of the laundry dryer according to one embodiment of the present disclosure.
Figure 7A:
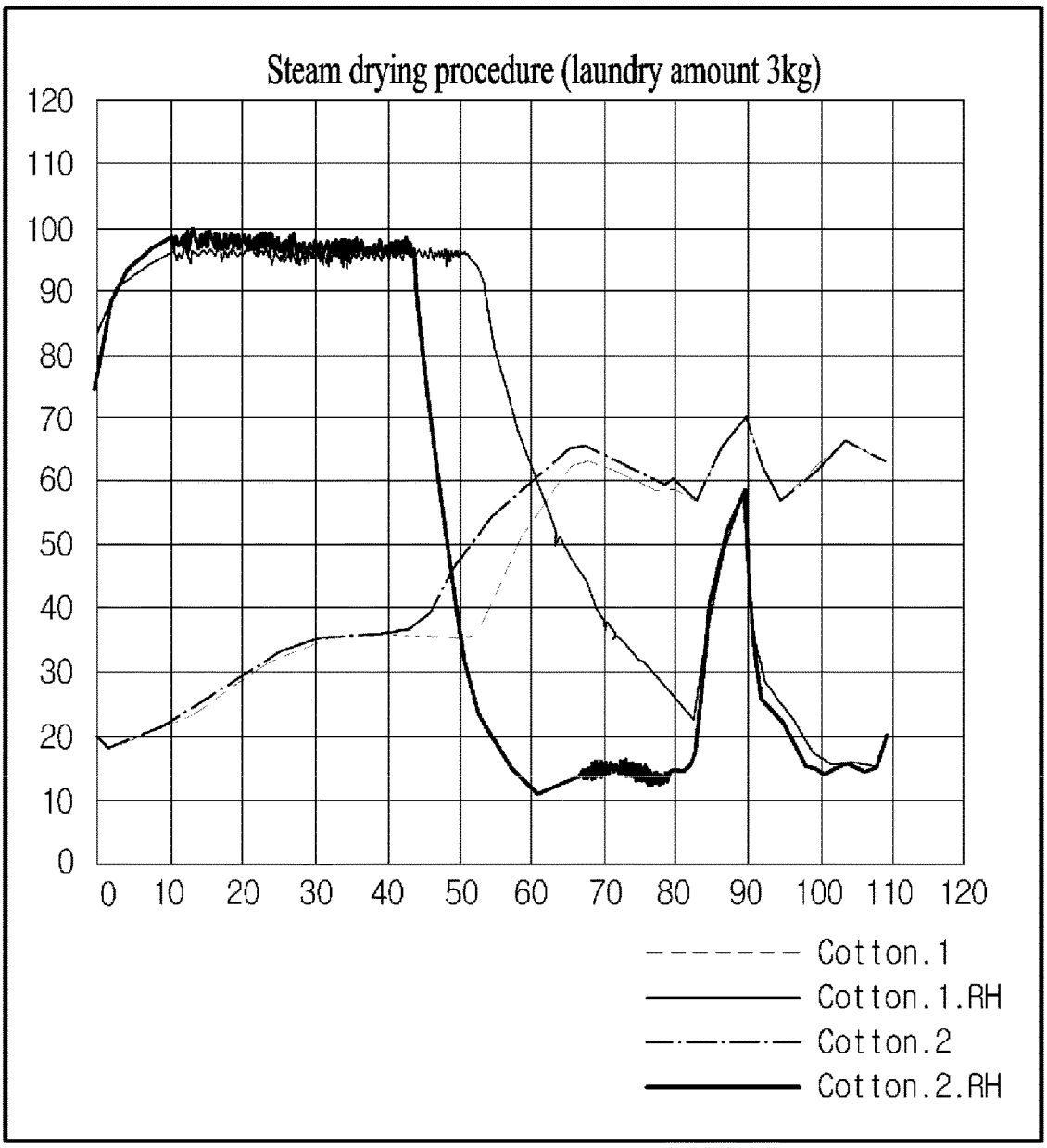
FIG. 7A exemplarily depicts the principle of high-temperature sterilization of an object to be dried under a low temperature condition according to the control method of the laundry dryer according to one embodiment of the present disclosure.
Figure 7B:
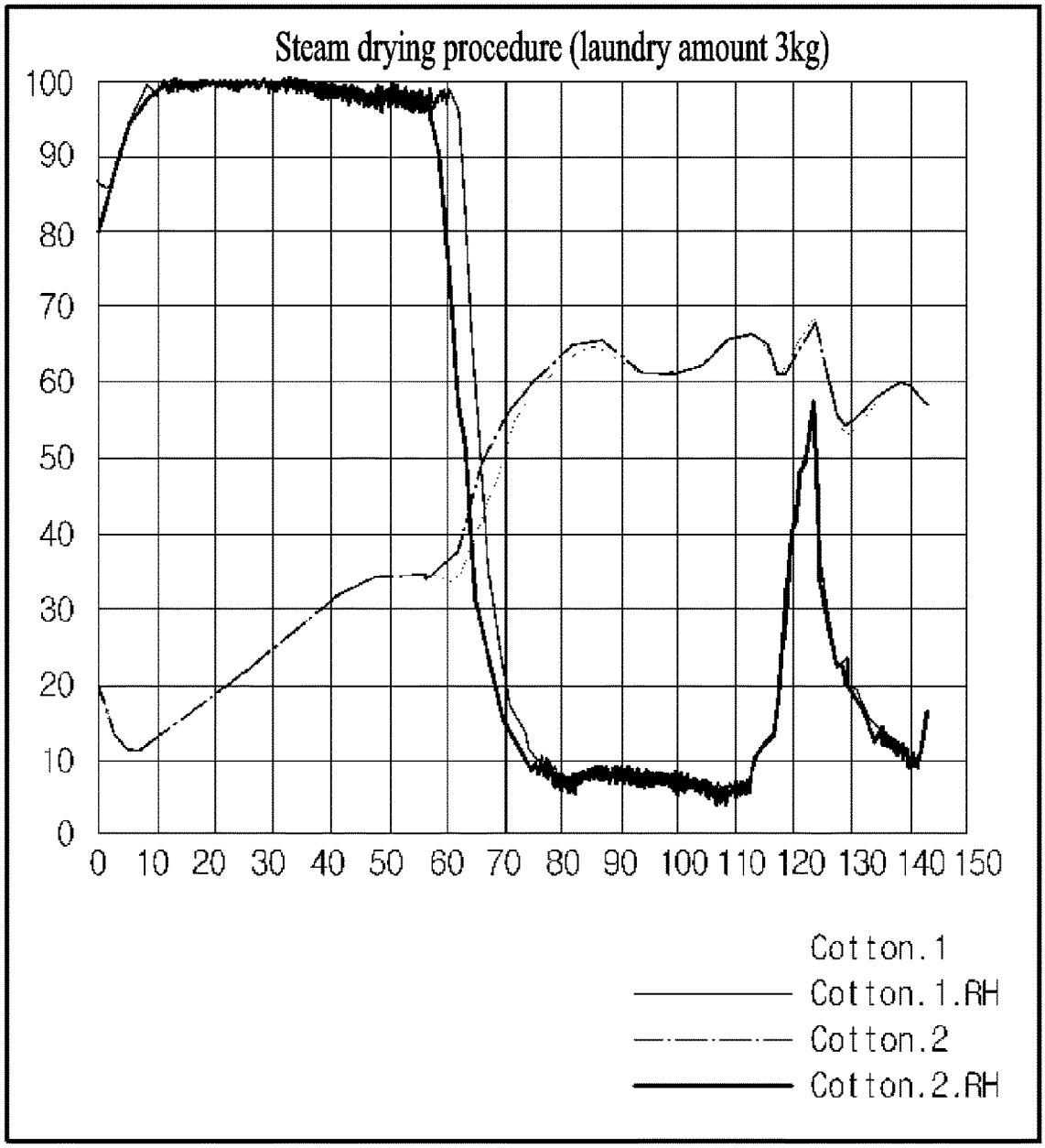
FIG. 7B exemplarily depicts the principle of high-temperature sterilization of an object to be dried under a room temperature condition according to the control method of the laundry dryer according to one embodiment of the present disclosure.
Figure 7C:
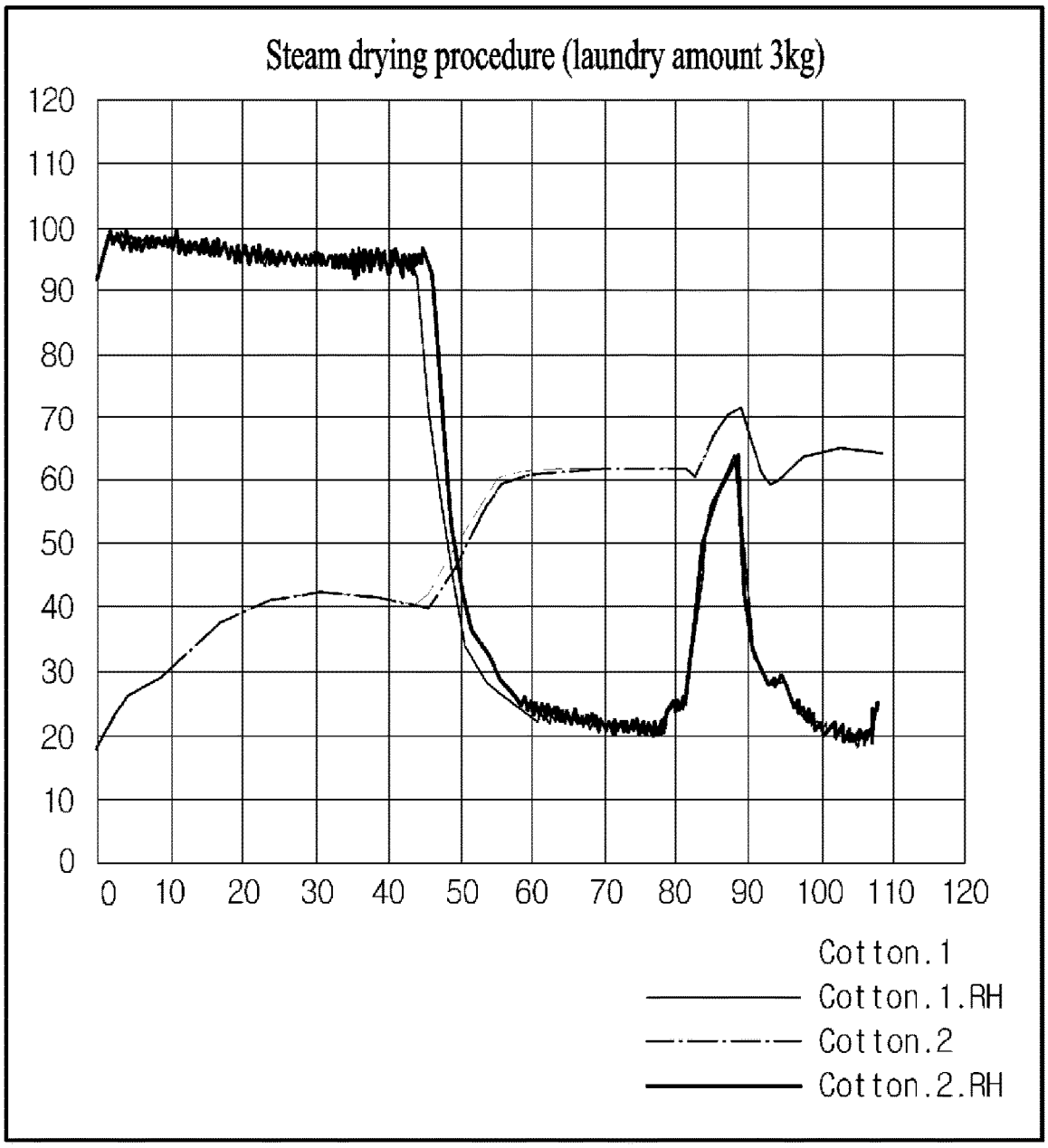
FIG. 7C exemplarily depicts the principle of high-temperature sterilization of an object to be dried under a high temperature condition according to the control method of the laundry dryer according to one embodiment of the present disclosure.
Figure 8:
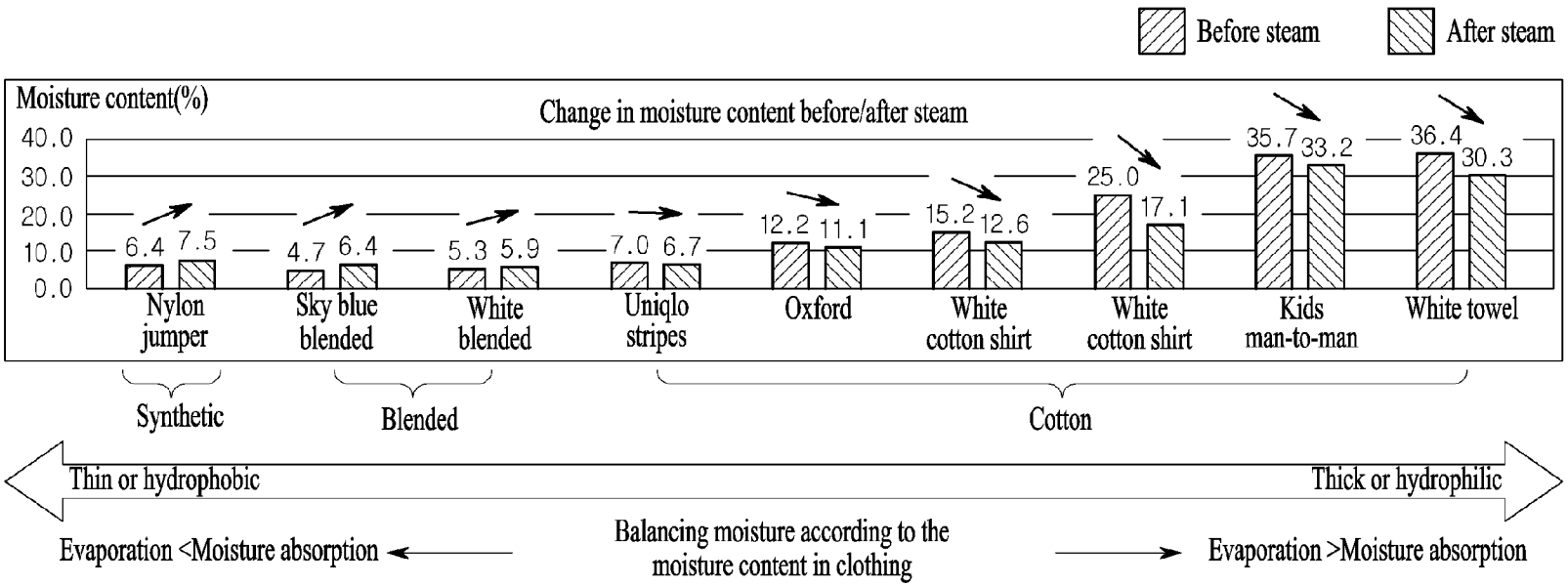
FIG. 8 is an exemplary diagram illustrating a moisture balance in objects to be dried according to the control method of the laundry dryer according to one embodiment of the present disclosure.
Figure 9:
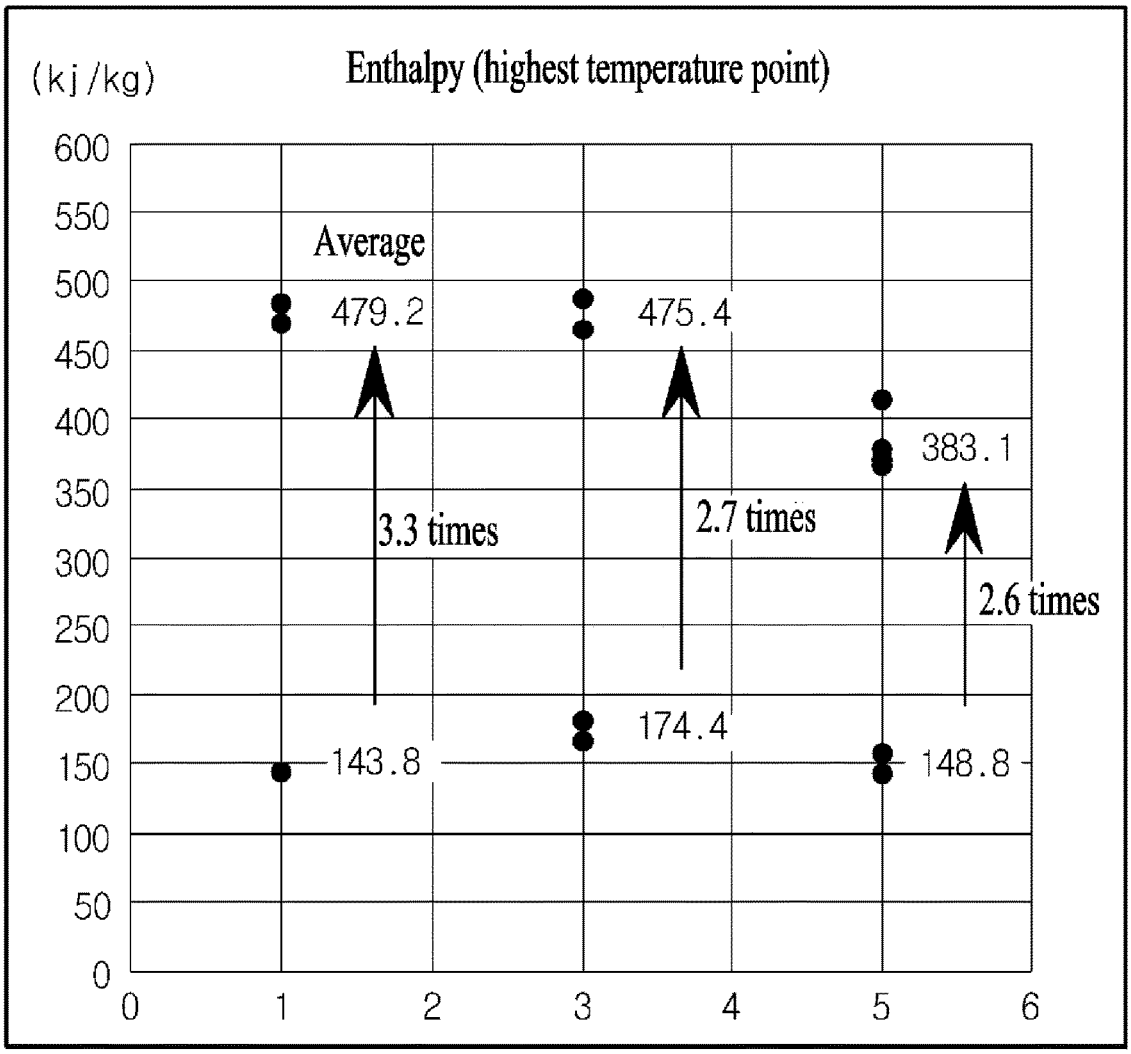
FIG. 9 is a graph depicting an increase in enthalpy according to the control method of the laundry dryer according to one embodiment of the present disclosure.

FIGS. 6A to 6C exemplarily depict changes in temperature of a duct part and a compressor according to a control method of the laundry dryer according to one embodiment of the present disclosure, and FIGS. 7A to 7C exemplarily depict the principle of high-temperature sterilization of objects to be dried according to the control method of the laundry dryer according to one embodiment of the present disclosure. FIG. 8 is an exemplary diagram illustrating a moisture balance in objects to be dried according to the control method of the laundry dryer according to one embodiment of the present disclosure, and FIG. 9 is a graph depicting an increase in enthalpy according to the control method of the laundry dryer according to one embodiment of the present disclosure.

The damage prevention effect for objects to be dried and the sterilization (sanitization) effect for the objects to be dried according to the present disclosure will be described with reference to FIGS. 1 to 9.

In the control method of the laundry dryer 1 according to one embodiment of the present disclosure, the drum 20 of the present disclosure is rotated in the steam drying procedure laundry amount sensing operation S20 to sense the load (S21), and is controlled to rotate at a constant speed in the steam drying procedure S30, the steam drying procedure steam supply operation S40, the re-drying operation S50, and the steam drying procedure cooling operation S60 (S31, S41, S51, S61).

That is, the drum 20 continues to rotate after the steam drying procedure laundry amount sensing operation S20. Accordingly, in the present disclosure, the drum 20 serves to turn over and mix the objects to be dried to evenly supply hot air and steam are to the objects to be dried.

Accordingly, in the present disclosure, the continuous rotation of the drum 20 may evenly dry the objects to be dried and prevent hot air from being concentrated on a portion of the objects to cause damage thereto. In addition, since steam is evenly supplied to the objects to be dried by the rotation of the drum 20, the entire objects to be dried may be evenly sterilized (sanitized).

The compressor 45 of the present disclosure is driven in the steam drying procedure drying operation S30 to increase the temperature inside the drum 20 (S32), and then the driving of the compressor 45 is stopped in the steam drying procedure steam supply operation S40 (S42). The compressor 45 is driven again in the re-drying operation S50 to dry the objects to be dried (S52).

The compressor 45 serves to heat air flowing inside the duct part 30 to provide hot air (heat) to be supplied into the drum 20. Accordingly, moisture may be evaporated from the objects to be dried through the driving of the compressor 45, and the sterilization (sanitization) effect may be obtained by the heat supplied from the compressor 45.

The circulation fan 43 of the present disclosure starts to rotate in the steam drying procedure drying operation S30 and is rotated by gradually increasing the rotational speed thereof according to a preset condition (S33*a*, S33*b*, and S33*c*). In the steam drying procedure steam supply operation S40, the rotation of the circulation fan 43 is stopped when steam is sprayed (S43*b*). Then, the circulation fan 30 is rotated again in the re-drying operation S50 and the steam drying procedure cooling operation S60 (S53 and S63).

The circulation fan 43 of the present disclosure, which is controlled irrespective of the rotation of the drum 20, is rotated when cooling is required after heated air is moved by driving the compressor 45 or drying is completed. Rotation of the circulation fan 43 is stopped when steam is sprayed, which does not require flow of air.

Accordingly, with the circulation fan 43 of the present disclosure, the supply efficiency of steam may be improved, and the sterilization (sanitization) efficiency for the objects to be dried may be improved.

In addition, the rotational speed of the circulation fan 43 of the present disclosure may be changed independently of the rotational speed of the drum. Accordingly, the rotational speed of the circulation fan 43 may be changed in response to the temperature of the objects to be dried, the temperature of the drum 20, or the temperature of the refrigerant discharged from the compressor 45 during the steam drying procedure drying operation S30. Thereby, the circulation efficiency of hot air may be improved.

The steam part 90 of the present disclosure receives water for generation of steam in the steam drying procedure laundry amount sensing operation S20 (S24), and is operated for preheating S44*a* for steam generation and steam spray S44*b* in the steam drying procedure steam supply operation S40.

After the steam drying procedure drying operation S30 is finished, the steam part 90 may supply steam to the objects to be dried to mitigate the moisture imbalance that may occur between the objects to be dried and increase the enthalpy inside the drum 20. Thereby, the sterilization (sanitization) effect may be enhanced.

First, the moisture imbalance mitigation effect according to the present disclosure will be described in detail.

When multiple objects to be dried are simultaneously dried, the moisture evaporation rate may depend on the thickness of the objects to be dried and the characteristics of the material of the objects. In other words, moisture may remain in an object formed of a thick or hydrophilic material even after the steam drying procedure drying operation S30. Little moisture may remain in an object formed of a thin or hydrophobic material after the steam drying procedure drying operation S30.

At this time, when moisture is supplied to the objects to be dried through the steam drying procedure steam supply operation S40, moisture is reabsorbed by the object formed of the thin or hydrophobic material, while the object formed of a thick or hydrophilic material undergoes an increase in the evaporation amount along with an increase in humidity. Thereby, the overall moisture content is balanced among the objects to be dried.

Therefore, according to the present disclosure, the overall degree of drying of the objects to be dried may become uniform through the steam drying procedure steam supply operation S40 and the re-drying operation S50 (see FIG. 8).

In addition, even when the objects to be dried are over-dried in the steam drying procedure drying operation S30, moisture may be replenished through the steam drying procedure steam supply operation S40. Accordingly, damage to the objects may be prevented.

Next, the sterilization (sanitization) effect according to the present disclosure will be described in detail.

In the steam drying procedure drying operation S30, when hot air is supplied to the objects to be dried, moisture is first removed from the objects to be dried. Thereafter, when the steam drying procedure drying operation S30 continues, the temperature of the inside of the drum 20 or the objects to be dried reaches a reference temperature required for sterilization (sanitization) (see FIGS. 6A to 7C). At this time, when high-temperature steam is sprayed from the steam part 90 of the present disclosure onto the objects to be dried, the humidity of the objects to be dried rises instantaneously (see FIGS. 7A to 7C). The microorganisms present in the objects to be dried are exposed to the high thermal energy of the high-temperature steam, and thus the cells thereof may be destroyed. Thus, the microorganisms are killed.

In contrast, in the absence of the steam drying procedure steam supply operation S40 of the present disclosure, the amount of heat generated by driving the compressor 45 in the steam drying procedure drying operation S30 is used to remove moisture from the objects to be dried. Even when the temperature of the objects to be dried rises to reach a standard temperature (e.g., 60° C.) required for sterilization, there is a limit to providing sufficient heat for sterilization because most moisture has already been removed from the objects or the drum 20.

The temperature of the drum 20 may be further increased for additional supply of heat. However, when only hot air is further supplied, the objects to be dried may dry out and may be damaged due to friction.

According to the present disclosure, both prevention of damage to the objects to be dried and sterilization of the objects may be obtained through the steam drying procedure steam supply operation S40 and the re-drying operation S50.

Figure 10:
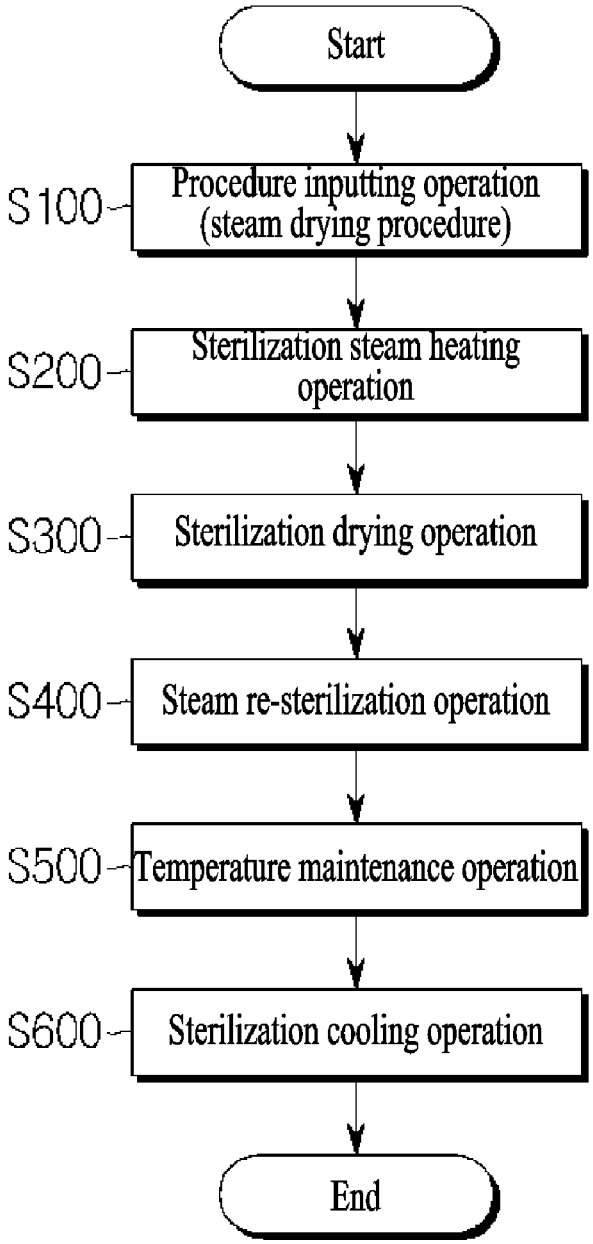
FIG. 10 is a flowchart illustrating a control method of the laundry dryer for a steam sterilization procedure according to another embodiment of the present disclosure.
Figure 11A:
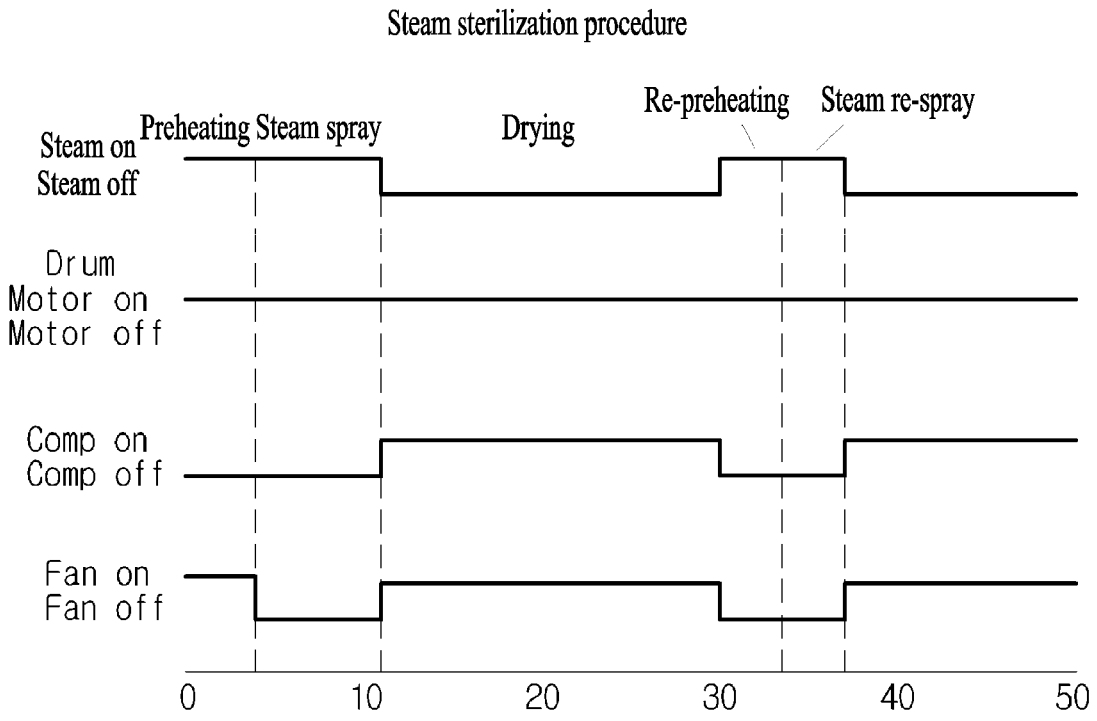
FIGS. 11A and 11B illustrate a specific application example of a steam drying method related to the other embodiment of the present disclosure.
Figure 11B:
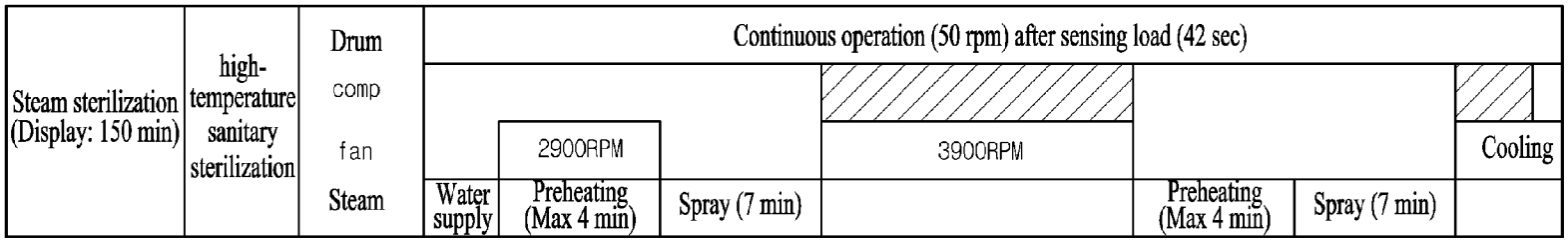

FIG. 10 is a flowchart illustrating a control method of the laundry dryer 1 according to another embodiment of the present disclosure, and FIGS. 11A and 11B illustrate a specific application example of a steam drying method related to the other embodiment of the present disclosure.

A control method of the laundry dryer 1 according to another embodiment of the present disclosure will be described with a reference to FIGS. 1 to 3, 10, 11A, and 11B.

The control method of the laundry dryer 1 according to the other embodiment of the present disclosure may include a procedure inputting operation S100, a sterilization steam heating operation S200, a sterilization drying operation S300, a steam re-sterilization operation S400, a temperature maintenance operation S500, and a sterilization cooling operation S600.

In the procedure inputting operation S10, a control input for execution of a steam sterilization procedure for sterilizing microorganisms that may be present in objects to be dried including clothes, towels, and bedding is input.

That is, when the laundry dryer 1 of the present disclosure is turned on, the user may input a control input through the input unit 118. The user may input the steam sterilization procedure to sterilize microorganisms that may be present in the objects to be dried.

Here, the microorganisms may include *Staphylococcus aureus, Pseudomonas aeruginosa, Escherichia coli*, and dust mites.

In the sterilization steam heating operation S200, the controller 100 may supply steam into the drum 20.

Here, in the sterilization steam heating operation S200, the controller 100 may sense the laundry amount of the objects to be dried through the rotation of the drum 20 (S210*a*). After sensing the laundry amount, the controller 100 may continuously rotate the drum 20 at a constant speed (S210*b*).

That is, in the sterilization laundry amount sensing operation S210*a* of sensing the laundry amount, the controller 100 may sense the load of the objects to be dried by rotating the drum 20, and sense the laundry amount of the objects to be dried based on the sensed load.

In the operation S210*b* of rotating the drum at the constant speed, the controller 100 may rotate the drum 20 at a pre-input reference speed Wr. For example, the controller 100 may continuously rotate the drum 20 at a rotational speed higher than or equal to 45 rpm and lower than or equal to 55 rpm.

At this time, the controller 100 skips driving the compressor 45 to prevent an instantaneous increase in power consumption of the laundry dryer 1 (S220).

In the sterilization steam heating operation S200, the controller 100 may control the rotation of the circulation fan 43 in connection with the operation control of the steam part 90, which will be described later (S230).

In the present disclosure, the controller 100 may control the steam part 90 to supply steam into the drum 20 (S240).

The sterilizing steam heating operation S200 may further include a sterilizing steam supply operation S240*a*, a sterilizing steam preheating operation S240*b*, and a sterilizing steam spraying operation S240*c*.

In the sterilization steam water supply operation S240*a*, the controller 100 may supply water from the water supplier 80 to the steam part 90. According to an embodiment, the controller 100 operate a water supply pump provided in the internal water supplier 81 to supply water into the steam generator 91, and may open the direct water valve 82*a* provided in the external water supplier 82 to supply water into the steam generator 91.

For example, in the sterilization steam water supply operation S240*a*, water more than or equal to 150 cc and less than or equal to 250 cc may be supplied from the water supplier 80 to the steam generator 91, and the time required to supply water from the water supplier 80 to the steam generator 91 may be longer than or equal to 30 seconds and shorter than or equal to 1.

In the sterilization steam supplying operation S240*a*, the controller 100 skips rotating the circulation fan 43 (S230*a*).

In the sterilization steam preheating operation S240*b*, the controller 100 may apply power to the steam part 90 to heat water supplied for steam generation for a preset preheating time th.

Specifically, in the sterilization steam preheating operation S240*b*, the controller 100 may heat water supplied to the steam generator 91 by applying power to a heater (not shown) provided in the steam generator 91. In this operation, the controller 100 may apply power to the heater for the preheating time th. The preheating time th may be set to be greater than or equal to a time required for the water to reach a boiling point.

For example, in the sterilization steam preheating operation S240*b*, the controller 100 may generate a control command to apply power to the steam part 90 for a time longer than or equal to 3 minutes 30 seconds and shorter than or equal to 4 minutes 30 seconds.

In the sterilization steam preheating operation S240*b*, the controller 100 may drive the circulation fan 43 at a preset first circulation speed Vs1 for a preset circulation time tcs.

For example, in the sterilization steam preheating operation S240*b*, the controller 100 may drive (rotate) the circulation fan 43 at a speed greater than or equal to 2500 rpm and less than or equal to 3500 for a time longer than or equal to 3 minutes 30 seconds and shorter than or equal to 4 minutes 30 (S230*b*).

In the sterilization steam spraying operation S240*c* after the sterilization steam preheating operation S240*b*, the controller 100 may spray the steam generated from the steam part 90 into the drum 20 by a preset spray amount.

Specifically, in the sterilization steam spraying operation S240*c*, the controller 100 may generate a control command for the steam generator 91 such that water that is heated by the steam generator 91 and starts boiling flows through the steam pipe 92 and is sprayed into the drum body 21 through the steam nozzle 93.

For example, in the sterilization steam spraying operation S240*c*, the controller 100 may cause water whose amount is greater than or equal to 150 cc and less than or equal to 250 cc to be sprayed from the steam generator 91 into the drum 20. In this case, the time required to spray the steam may be longer than or equal to 6 minutes 30 seconds and shorter than or equal to 7 minutes 30 seconds.

In the sterilization steam spraying operation S240*c*, after the circulation time tcs has elapsed, the controller 100 may stop rotating the circulation fan 43 in order to sufficiently supply steam to the objects to be dried (S230*c*).

Accordingly, in the sterilization steam heating operation S200, the controller 100 may operate the steam generator 91 and the drum 20. The controller 100 may rotate and the circulation fan 43 during steam preheating. During steam spray, the controller 100 may stop rotating the circulation fan 43 and skip driving the compressor 45.

Accordingly, as the high-temperature steam is absorbed into the objects to be dried by the sterilization steam heating operation S200, the temperature of the objects to be dried may rise, and hot air heating in the sterilization drying operation S300, which will be described later, may be prevented from causing damage to the objects.

In the sterilization drying operation S300, the internal temperature of the drum 20 to which steam is supplied may be increased.

When the internal temperature of the drum 20 rises to a preset sterilization temperature Ts in the sterilization drying operation S300, the controller 100 may enter the steam re-sterilization operation S400, which will be described later.

The sterilization drying operation S300 may include an operation S310 of rotating the drum 20 at a pre-input reference speed Wr input by the controller 100. For example, the controller 100 may continuously rotate the drum 20 at a rotational speed greater than or equal to 45 rpm and less than or equal to 55.

In addition, the sterilization drying operation S300 may include an operation S320 of driving (rotating) the compressor 45 by the controller 100.

In this case, the controller 100 may control the operating frequency f of the compressor 45 within a preset maximum frequency fmax range.

For example, the controller 100 may drive the compressor 45 by raising or lowering the operating frequency f within a maximum frequency fmax range of 85 Hz to 105 Hz.

When entering the sterilization drying operation S300, the controller 100 may drive the compressor 45 at the operating frequency f equal to the maximum frequency fmax in order to quickly increase the internal temperature of the drum 20 (S320*a*).

In this operation, the controller 100 may generate a control command to increase output power for driving of the compressor 45 up to the maximum frequency fmax at one time, or may generate a control command to increase the rotational speed of the compressor motor 45*a* in multiple stages in order to prevent the compressor motor 45*a* from being overloaded to be broken.

As an example, the controller 100 may first generate a control command for driving the compressor 45 at a frequency greater than or equal to 55 Hz and less than or equal to 65 Hz, and then generate a control command for driving the compressor 45 at a frequency greater than or equal to 75 Hz and less than or equal to 85 Hz. Then, the controller 100 may finally generate a control command for driving the compressor 45 at the operating frequency f.

After driving the compressor 45 at the operating frequency f equal to the maximum frequency fmax, the controller 100 may sense the temperature inside the drum 20 for energy efficiency and failure prevention, and drive the compressor 45 while maintaining the operating frequency f to be lower than the maximum frequency fmax (S320*b*).

At this time, the controller 45 may sense (measure) the temperature inside the drum 20 through the sensor 116 installed in the duct part 30. In the sterilization drying operation S300, as the circulation fan 43 continues to rotate as described later, the air inside the drum 20 continues to circulate while flowing inside the duct part 30. Accordingly, the controller 100 may measure the temperature inside the drum 20 through the sensor 116 installed in the duct part 30. The sensor 116 installed in the duct part 30 may be a temperature sensor.

When the internal temperature T of the drum 20 rises to a preset sterilization temperature Ts (T≥Ts) in the sterilization drying operation S300, the controller 100 may stop driving the compressor 45, and enter the steam re-sterilization operation S400, which will be described later (S320*c*).

Specifically, when the temperature T measured through the sensor 116 installed in the duct part 30 is higher than or equal to 60° C., the controller 100 may stop driving the compressor 45.

The sterilization drying operation S300 may include an operation S330 of rotating the circulation fan 43 by the controller 100.

Specifically, in the sterilization drying operation S300, the controller 100 may drive the circulation fan 43 at a preset second circulation speed Vs2 while the compressor 45 is being driven.

For example, in the sterilization drying operation S300, the controller 100 may drive (rotate) the circulation fan 43 at a speed greater than or equal to 3500 rpm and less than or equal to 4500 rpm while the compressor 45 is being driven.

In the sterilization drying operation S300, the controller 100 may skip operating the steam part 90 (S340).

That is, in the sterilization drying operation S300, the controller 100 may drive the drum 20, the circulation fan 43, and the compressor 45.

Accordingly, according to the sterilization drying operation S300, heat exchange may occur between the air flowing through the drum 20 and the duct part 30 and the refrigerant of the heat exchanger 40 by driving of the compressor 45, the temperature inside the drum 20 and the duct part 30 may increase, and the temperatures inside the drum 20 and the duct part 30 may increase to a temperature Ts required for sterilization of the objects to be dried.

In the steam re-sterilization operation S400, the controller 100 may supply steam into the drum 20.

In the steam re-sterilization operation S400, the controller 100 may continuously rotate the drum 20 at the pre-input reference speed Wr (S410). For example, the controller 100 may continuously rotate the drum 20 at a rotational speed greater than or equal to 45 rpm and less than or equal to 55.

In the steam re-sterilization operation S400, the controller 100 stops driving the compressor 45 to prevent an instantaneous increase in power consumption of the laundry dryer 1 (S420).

In the steam re-sterilization operation S400, the controller 100 stops the rotation of the circulation fan 43 in order to reduce the flow of steam to supply sufficient steam to the drum 20 (S430).

In the steam re-sterilization operation S400, the controller 100 may control the steam part 90 to supply steam into the drum 20 (S440).

The steam re-sterilization operation S400 may include a steam water resupply operation S440*a*, a steam re-preheating operation S440*b*, and a steam re-spraying operation S440*c*.

In the steam water resupply operation S440*a*, the controller 100 may supply water from the water supplier 80 to the steam part 90. According to an embodiment, the controller 100 may operate a water supply pump provided in the internal water supplier 81 to supply water into the steam generator 91, and may open the direct water valve 82*a* provided in the external water supplier 82 to supply water into the steam generator 91.

For example, in the steam water resupply operation S440*a*, water more than or equal to 150 cc and less than or equal to 250 cc may be supplied from the water supplier 80 to the steam generator 91, and the time required to supply water from the water supplier 80 to the steam generator 91 may be longer than or equal to 30 seconds and shorter than or equal to 1.

In the steam re-heating operation S440*b*, the controller 100 may apply power to the steam part 90 to heat the water supplied for steam generation for a preset preheating time th.

Specifically, in the steam reheating operation S440*b*, the controller 100 may heat water supplied to the steam generator 91 by applying power to a heater (not shown) provided in the steam generator 91. In this operation, the controller 100 may apply power to the heater for the preheating time th. The preheating time th may be set to be greater than or equal to a time required for the water to reach a boiling point.

For example, in the steam reheating operation S440*b*, the controller 100 may generate a control command to apply power to the steam part 90 for a time longer than or equal to 3 minutes 30 seconds and shorter than or equal to 4 minutes 30 seconds.

In the steam re-spraying operation S440*c* after the steam re-preheating operation S440*b*, the controller 100 may spray the steam generated from the steam part 90 into the drum 20 by a preset spray amount.

Specifically, in the steam re-spraying operation S440*c*, the controller 100 may generate a control command for the steam generator 91 such that water that is heated by the steam generator 91 and starts boiling flows through the steam pipe 92 and is sprayed into the drum body 21 through the steam nozzle 93.

For example, in the steam re-spraying operation S440*c*, the controller 100 may cause water whose amount is greater than or equal to 150 cc and less than or equal to 250 cc to be sprayed from the steam generator 91 into the drum 20. In this case, the time required to spray the steam may be longer than or equal to 6 minutes 30 seconds and shorter than or equal to 7 minutes 30 seconds.

Therefore, according to the steam re-sterilization operation S400, the controller 100 may supply high-temperature moisture into the drum 20 through the steam part 90, thereby increasing the enthalpy inside the drum 20 and improving the sterilization (sanitization) effect.

In the temperature maintenance operation S500 after the steam re-sterilization operation S400, the controller 100 may maintain the internal temperature of the drum 20 for a preset maintenance time.

In the temperature maintenance operation S500, the controller 100 may continuously rotate the drum 20 at the pre-input reference speed Wr (S510). For example, the controller 100 may continuously rotate the drum 20 at a rotational speed higher than or equal to 45 rpm and lower than or equal to 55 rpm.

The temperature maintenance operation S500 may include a reheating operation S520*a* and a heating control operation S520*b*.

The reheating operation S520*a* may be performed when the controller enters the temperature maintenance operation S500 after the steam re-sterilization operation S400.

In the reheating operation S520*a*, the controller 100 may drive the compressor 100 at a preset safety frequency fs.

For example, in the reheating operation S520*a*, the controller 100 may drive the compressor 100 at a frequency greater than or equal to 25 Hz and less than or equal to 35 Hz.

That is, the controller 100 may supply steam into the drum 20 by re-operating the steam part 90 and then drive the compressor 45 at the safety frequency fs.

Accordingly, according to the present disclosure, a situation in which a malfunction occurs in the laundry dryer 1 or a situation in which the power supplied to the laundry dryer 1 is suddenly cut off may be prevented.

More specifically, when the temperature maintenance operation S500 is entered after the steam re-sterilization operation S400, the power supply applied to the steam generator 91 and the power supply starting to be applied to the compressor 45 may instantaneously overlap with each other.

As a result, the total power consumption of the laundry dryer may increase rapidly, which may cause a malfunction in the laundry dryer 1 or the power supplied to the laundry dryer may be suddenly cut off.

In order to address this issue, in the present disclosure, when entering the temperature maintenance operation S500, the controller 100 drives the compressor 45 by setting the operating frequency f to the safety frequency fs. In this case, since the power supplied to the compressor 45 is relatively low, a sudden increase in total power consumption may be prevented.

In the heating control operation S520*b* after the reheating operation S510*a*, the controller 100 may measure the temperature inside the duct part 30, and perform a control operation to change the operating frequency f of the compressor 45 according to the measured temperature inside the duct part 30 to maintain the temperature inside the duct part 30.

Specifically, in the heating control operation S520*b*, when the operation of the steam generator 91 is terminated and the overall power consumption is stabilized through the reheating operation S510*a*, the controller 100 measures the temperature inside the duct part 30, and changes the operating frequency f in order to maintain the temperature T inside the duct part 30 above the sterilization temperature Ts.

That is, when the temperature T inside the duct part 30 continues to increase beyond the sterilization temperature Ts, the controller 100 generates a control command to reduce the operating frequency f to drive the compressor 45. In addition, when the temperature T inside the duct part 30 starts to decrease from above the sterilization temperature Ts, the controller 100 generates a control command to increase the operating frequency f to drive the compressor 45.

Therefore, according to the present disclosure, in the heating control operation S520*b*, the controller 100 may continuously maintain the sterilization temperature Ts.

In the heating control operation S520*b*, the controller 100 may maintain the temperature T inside the duct part 30 above the sterilization temperature Ts for a preset temperature maintenance time tm, and then terminate driving of the compressor 45.

For example, in the heating control operation S520*b*, the controller 100 may maintain the temperature T inside the duct part 30 at 60° C. or higher for a time longer than or equal to 70 minutes and shorter than or equal to 80 minutes (preferably for 75 minutes), and then terminate the driving of the compressor 45.

In the temperature maintenance operation S500, the controller 100 may rotate (drive) the circulation fan 43 while maintaining the second circulation speed Vs2 as the rotational speed of the circulation fan 43 (S530).

In the temperature maintenance operation S500, since sufficient moisture has been supplied to the objects to be dried, the controller 100 may skip (stop) operating the steam part 90 (S540).

Accordingly, in the temperature maintenance operation S500, the controller 100 may operate the drum 20, the compressor 45, and the circulation fan 43. In particular, the controller 100 may maintain the temperature T inside the duct part 30 above the sterilization temperature Ts while changing the operating frequency of the compressor 45.

Therefore, the objects to be dried may be maintained at a temperature higher than or equal to the sterilization temperature Ts by the temperature maintenance operation S500 for a time longer than or equal to a reference time required for sterilization.

In the sterilization cooling operation S600 after the temperature maintenance operation S500, the controller 100 may perform a control operation to blow hot air inside the drum 20 for a pre-input blowing time to cool the objects to be dried.

For example, in the sterilization cooling operation S600, the controller 100 may cool the objects to be dried by blowing hot air inside the drum 20 for a time longer than or equal to 3 minutes 30 seconds and shorter than or equal to 4 minutes 30 seconds.

The sterilization cooling operation S600 may include an operation S610 of rotating the drum 20 at a pre-input reference speed Wr by the controller 100. For example, the controller 100 may continuously rotate the drum 20 while maintaining the drum 20 at a rotational speed higher than or equal to 45 rpm or lower than or equal to 55 rpm.

In the sterilization cooling operation S600, the controller 100 may terminate the driving of the compressor 45 to lower the temperature of the dried objects (S620).

In addition, in the sterilization cooling operation S600, the controller 100 may rotate (drive) the circulation fan 43 at the second circulation speed Vs2 as the rotational speed of the circulation fan 43 in order to blow the heated air inside the drum 20 (S630).

In the sterilization cooling operation S600, since sufficient moisture has been supplied to the objects to be dried, the controller 100 may skip (stop) operating the steam part 90 (S640).

Accordingly, in the sterilization cooling operation S600, the controller 100 may lower the temperature of the objects to be dried by rotating the drum 20 and the circulation fan 43.

Figure 12:
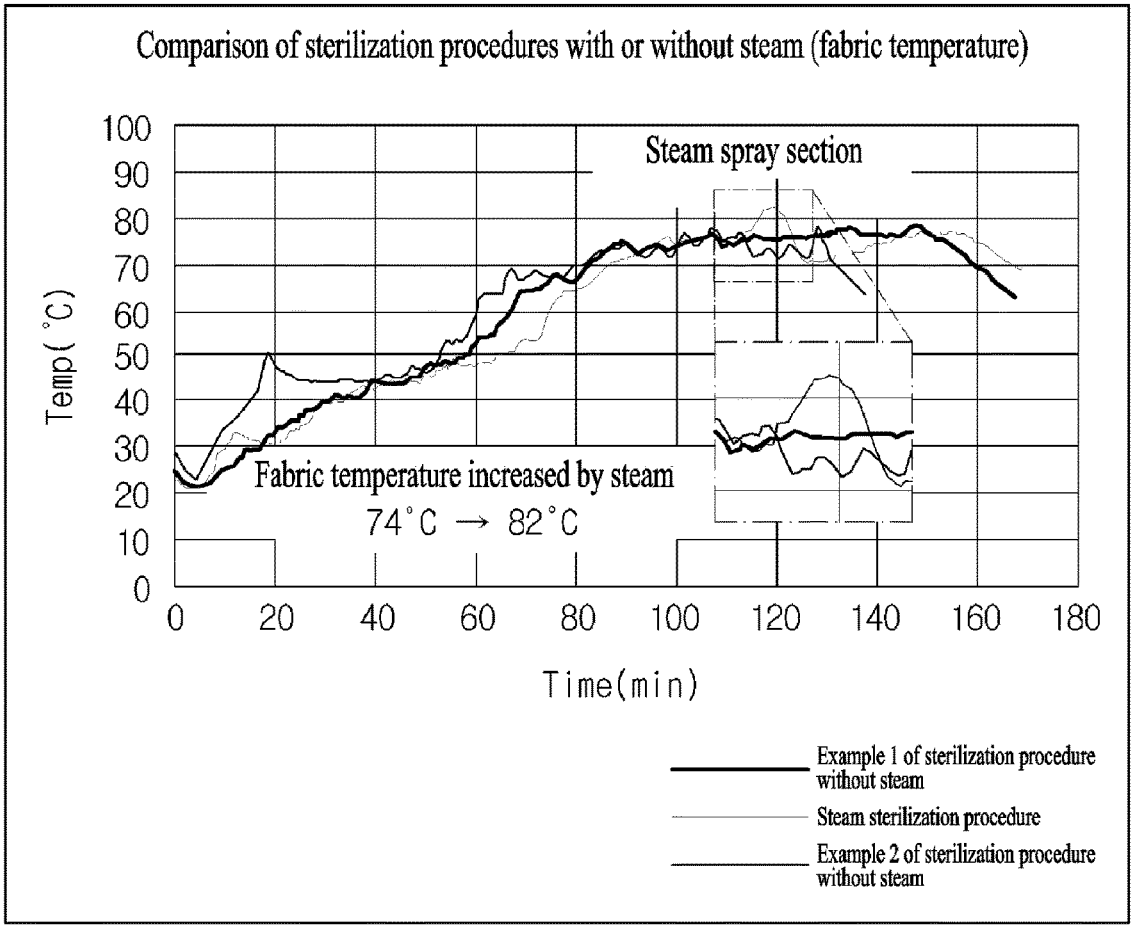
FIG. 12 exemplarily depicts a change in temperature of objects to be dried according to the control method of the laundry dryer according to the other embodiment of the present disclosure.
Figures 13, 14:
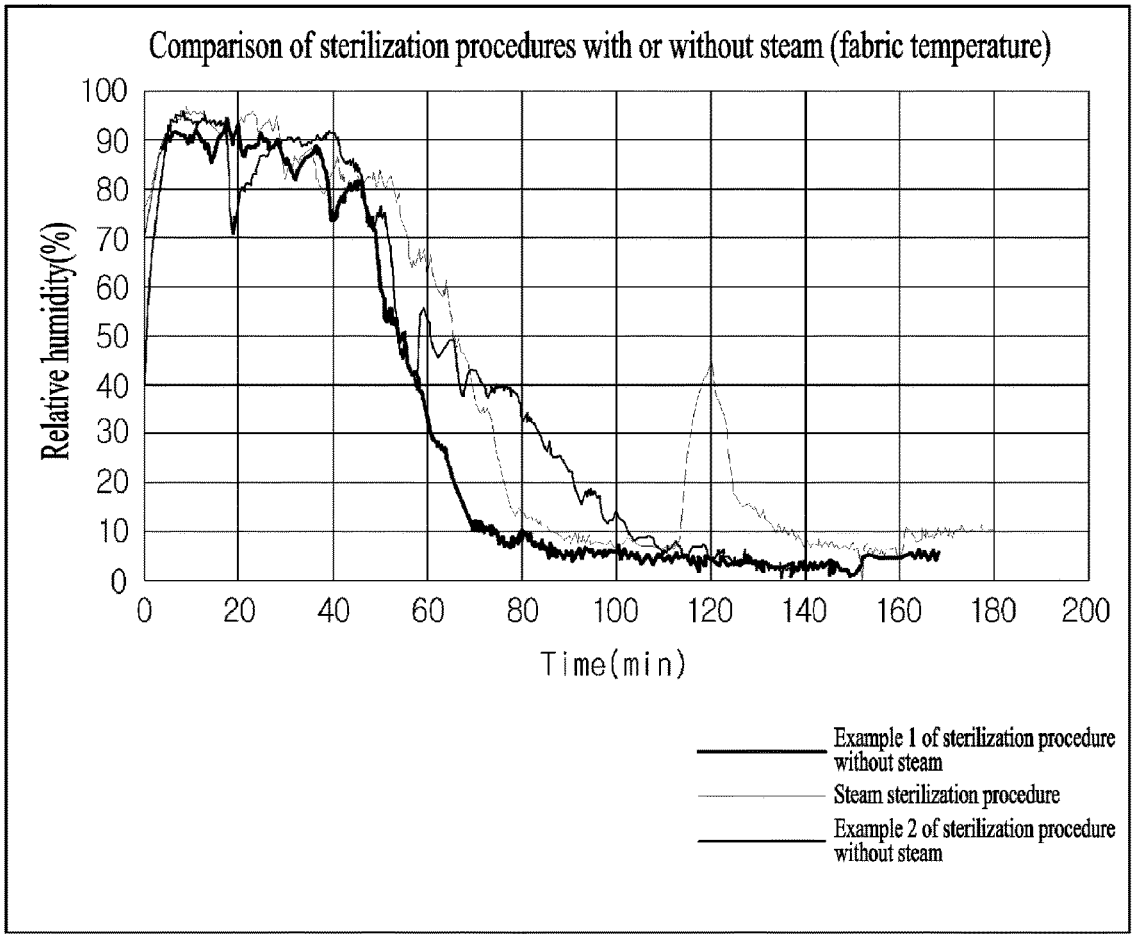
FIG. 13 exemplarily depicts a change in humidity of objects to be dried according to the control method of the laundry dryer according to the other embodiment of the present disclosure.
FIG. 14 is a table for explaining sterilization conditions of objects to be dried according to the control method of the laundry dryer according to the other embodiment of the present disclosure.

FIG. 12 exemplarily depicts a change in temperature of objects to be dried according to the control method of the laundry dryer according to the other embodiment of the present disclosure, and FIG. 13 exemplarily depicts a change in humidity of objects to be dried according to the control method of the laundry dryer according to the other embodiment of the present disclosure. FIG. 14 is a table for explaining sterilization conditions of objects to be dried according to the control method of the laundry dryer according to the other embodiment of the present disclosure.

The damage prevention effect for objects to be dried and the sterilization (sanitization) effect for the objects to be dried according to the present disclosure will be described with reference to FIGS. 10 to 14.

According to the control method of the laundry dryer 1 according to the other embodiment of the present disclosure, the drum 20 of the present disclosure is rotated in the sterilization steam heating operation S200 to sense the load (S210), and is controlled to rotate at a constant speed in the sterilization drying operation S300, the steam re-sterilization operation S400, the temperature maintenance operation S500, and the sterilization cooling operation S600 (S310, S410, S510, S610).

That is, the drum 20 continues to rotate after the sterilization steam heating operation S200. Accordingly, in the present disclosure, the drum 20 serves to turn over and mix the objects to be dried to evenly supply hot air and steam are to the objects to be dried.

Accordingly, in the present disclosure, the continuous rotation of the drum 20 may evenly dry the objects to be dried and prevent hot air from being concentrated on a portion of the objects to cause damage thereto. In addition, since steam is evenly supplied to the objects to be dried by the rotation of the drum 20, the entire objects to be dried may be evenly sterilized.

The compressor 45 of the present disclosure starts to be driven in the sterilization drying operation S300 to increase the temperature inside the drum 20 (S320), and then the driving of the compressor 45 is stopped in the steam re-sterilization operation S400 (S420). The compressor 45 is driven again in the temperature maintenance operation S500 to sterilize the objects to be dried (S520).

The compressor 45 serves to heat air flowing inside the duct part 30 to provide hot air (heat) to be supplied into the drum 20. Accordingly, moisture may be evaporated from the objects to be dried through the driving of the compressor 45, and the sterilization (sanitization) effect may be obtained by the heat supplied from the compressor 45.

The circulation fan 43 of the present disclosure starts to rotate in the sterilization steam preheating operation S230*b*, and the rotation thereof is stopped in the sterilization steam spraying operation S230*c*. The circulation fan 43 is rotated again in the sterilization drying operation S300 (S330). The rotation is stopped in the steam re-sterilization operation S400 (S430), and then the circulation fan 43 is rotated again in the temperature maintenance operation S500 and the sterilization cooling operation S600 (S530, S630).

The circulation fan 43 of the present disclosure, which is controlled irrespective of the rotation of the drum 20, is rotated when cooling is required after heated air is moved by driving the compressor 45 or the sterilization is terminated. Rotation of the circulation fan 43 is stopped when steam is sprayed, which does not require flow of air.

Accordingly, with the circulation fan 43 of the present disclosure, the supply efficiency of steam may be improved, and the sterilization (sanitization) efficiency for the objects to be dried may be improved.

In addition, the rotational speed of the circulation fan 43 of the present disclosure may be changed independently of the rotational speed of the drum 20. Accordingly, the rotational speed of the circulation fan 43 may be changed in response to the temperature of the objects to be dried, the temperature inside the drum 20, or the temperature inside the duct part 30 during the sterilization drying operation S300. Thereby, the circulation efficiency of hot air may be improved.

The steam part 90 of the present disclosure receives water for steam generation in the sterilization steam heating operation S200 and the steam re-sterilization operation S400, and is operated for preheating for steam generation and steam spray.

The controller 100 may increase the efficiency of heating the inside of the drum 20 by supplying high-temperature moisture into the drum 20 through the steam part 90 in the sterilization steam heating operation S200.

That is, when hot steam is supplied to the objects to be dried in any cases where the objects to be dried has been washed or has not been washed, an amount of heat is transferred to the objects to be dried. At this time, when hot air is supplied in the sterilization drying operation S300, the temperature of the objects to be dried or the temperature inside the drum 20 may increase more rapidly.

The controller 100 may supply high-temperature moisture into the drum 20 through the steam part 90 in the steam re-sterilization operation S400, thereby increasing the enthalpy inside the drum 20 and improving the sterilization (sanitization) effect.

Next, the sterilization (sanitization) effect according to the present disclosure will be described in detail.

When hot air is supplied to the objects to be dried in the sterilization drying operation S300, the temperature of the inside of the drum 20 or the objects to be dried reaches a reference temperature (60° C. or higher) required for sterilization (sanitization). At this time, when the steam part 90 sprays high-temperature steam onto the objects to be dried in the steam re-sterilization operation S400 of the present disclosure, the enthalpy of the objects to be dried is increased.

Thereafter, through the temperature maintenance operation S500, the temperature T inside the drum 20 is maintained above the sterilization temperature Ts for a temperature maintenance time tm. Accordingly, microorganisms or the like present in the objects to be dried are exposed to high thermal energy, and thus the cells thereof may be destroyed. Thus, the microorganisms are killed. Here, the temperature maintenance time tm exceeds the time required to kill the microorganisms or the like as disclosed in FIG. 14.

In contrast, in the absence of the steam re-sterilization operation S400 of the present disclosure, the amount of heat generated by driving the compressor 45 in the sterilization drying operation S300 is used to remove moisture from the objects to be dried. Even when the temperature of the objects to be dried rises to reach a standard temperature (e.g., 60° C.) required for sterilization, there is a limit to providing sufficient heat for sterilization because most moisture has already been removed from the objects or the drum 20.

The temperature of the drum 20 may be further increased for additional supply of heat. However, when only hot air is further supplied, the objects to be dried may dry out and may be damaged due to friction.

According to the present disclosure, both prevention of damage to the objects to be dried and sterilization of the objects may be obtained through the steam re-sterilization operation S400 and the temperature maintenance operation S500.

Although the present disclosure has been described in detail through specific embodiments, this is merely intended to describe the present disclosure in detail, and the present disclosure is not limited thereto. It will be apparent to those skilled in the art that various modifications and variations can be made in the present disclosure without departing from the spirit and scope of the disclosure.

Thus, it is intended that the present disclosure cover the modifications and variations of this disclosure provided they come within the scope of the appended claims and their equivalents.

What is claimed is:

1. A laundry dryer comprising:

a cabinet that defines an exterior of the laundry dryer;

a drum rotatably disposed inside the cabinet and configured to receive an object to be dried;

a duct part configured to guide air discharged from the drum and to supply the air to the drum;

a circulation fan configured to move the air along the duct part;

a heat exchanger disposed at the duct part and configured to perform heat exchange with the air guided along the duct part;

a compressor configured to compress refrigerant that is configured to exchange heat with the air guided along the duct part;

a steam part configured to generate steam and to supply the steam into the drum; and a controller configured to control the drum, the circulation fan, the compressor, and the steam part, wherein the controller is configured to:

while supplying the steam into the drum through the steam part, rotate the drum and stop rotation of the circulation fan, increase an internal temperature of the drum by driving the compressor, and based on a temperature of the compressor being increased to a preset drying temperature, operate the steam part to supply the steam into the drum.

2. The laundry dryer of claim 1, wherein the controller is configured to, while supplying the steam into the drum through the steam part, stop driving the compressor.

3. The laundry dryer of claim 1, wherein the controller is configured to drive the compressor after supplying the steam into the drum through the steam part.

4. The laundry dryer of claim 1, wherein the controller is configured to rotate the circulation fan after supplying water from a water supplier to the steam part.

5. The laundry dryer of claim 4, wherein the controller is configured to rotate the circulation fan at a preset first drying speed for a preset drying time, and then accelerate the circulation fan to a preset second drying speed.

6. The laundry dryer of claim 1, wherein the controller is configured to drive the compressor after supplying water from a water supplier to the steam part.

7. The laundry dryer of claim 1, further comprising a drum motor configured to rotate the drum, wherein the circulation fan comprises an impeller motor that is configured to rotate the circulation fan, the impeller motor being configured to operate independently of the drum motor, and wherein the controller is configured to control the drum motor and the impeller motor independently of each other.

8. The laundry dryer of claim 1, wherein the controller is configured to operate the steam part for a preset preheating time to thereby heat water for generating the steam.

9. The laundry dryer of claim 8, wherein the controller is configured to rotate the circulation fan for the preset preheating time, and then stop rotating the circulation fan while spraying the steam through the steam part.

10. The laundry dryer of claim 1, wherein the controller is configured to:

after supplying the steam into the drum by operating the steam part, drive the compressor to increase the internal temperature of the drum; and based on the internal temperature of the drum being increased to a preset sterilization temperature, operate the steam part to supply additional steam from the steam part into the drum.

11. The laundry dryer of claim 10, wherein the controller is configured to, after operating the steam part to supply the additional steam into the drum, drive the compressor at a preset safety frequency.

12. The laundry dryer of claim 11, further comprising a sensor configured to sense a temperature inside the duct part, wherein the controller is configured to:

measure the temperature inside the duct part through the sensor, and control an operating frequency of the compressor based on the temperature inside the duct part to thereby maintain the temperature inside the duct part.

13. The laundry dryer of claim 12, wherein the controller is configured to stop driving the compressor after maintaining the temperature inside the duct part above the preset sterilization temperature for a preset temperature maintenance time.

14. A laundry dryer comprising:

a cabinet that defines an exterior of the laundry dryer;

a drum rotatably disposed inside the cabinet and configured to receive an object to be dried;

a duct part configured to guide air discharged from the drum and to supply the air to the drum;

a circulation fan configured to move the air along the duct part;

a heat exchanger disposed at the duct part and configured to perform heat exchange with the air guided along the duct part;

a compressor configured to compress refrigerant that is configured to exchange heat with the air guided along the duct part;

a steam part configured to generate steam and to supply the steam into the drum; and a controller configured to control the drum, the circulation fan, the compressor, and the steam part, wherein the controller is configured to:

while supplying the steam into the drum through the steam part, rotate the drum and stop rotation of the circulation fan, rotate the circulation fan after supplying water from a water supplier to the steam part, rotate the circulation fan at a preset first drying speed for a preset drying time, and then accelerate the circulation fan to a preset second drying speed, and based on a temperature of the compressor being greater than or equal to a preset drying temperature, increase a rotational speed of the circulation fan from the preset second drying speed to a preset third drying speed.

15. A laundry dryer comprising:

a cabinet that defines an exterior of the laundry dryer;

a drum rotatably disposed inside the cabinet and configured to receive an object to be dried;

a duct part configured to guide air discharged from the drum and to supply the air to the drum;

a circulation fan configured to move the air along the duct part;

a heat exchanger disposed at the duct part and configured to perform heat exchange with the air guided along the duct part;

a compressor configured to compress refrigerant that is configured to exchange heat with the air guided along the duct part;

a steam part configured to generate steam and to supply the steam into the drum; and a controller configured to control the drum, the circulation fan, the compressor, and the steam part, wherein the controller is configured to, while supplying the steam into the drum through the steam part, rotate the drum and stop rotation of the circulation fan, wherein the controller is configured to operate the steam part for a preset preheating time to thereby heat water for generating the steam, wherein the controller is configured to rotate the circulation fan for the preset preheating time, and then stop rotating the circulation fan while spraying the steam through the steam part, wherein the controller is configured to:

rotate the circulation fan at a first rotational speed for the preset preheating time; and after spraying the steam through the steam part, operate the compressor and the circulation fan to thereby dry the object in the drum, and wherein the controller is configured to, after spraying the steam through the steam part, rotate the circulation fan at a second rotation speed that is different from the first rotational speed of the circulation fan.

* * * * *